US005563361A

United States Patent [19]

Kondo et al.

[11] Patent Number: 5,563,361

[45] Date of Patent: Oct. 8, 1996

[54] AUTOMATIC ACCOMPANIMENT APPARATUS

[75] Inventors: Masao Kondo; Shinichi Ito; Hiroki Nakazono, all of Hamamatsu, Japan

[73] Assignee: Yamaha Corporation, Shizuoka-ken, Japan

[21] Appl. No.: 252,095

[22] Filed: May 31, 1994

[30] Foreign Application Priority Data

May 31, 1993 [JP] Japan ..... 5-129135
Jun. 8, 1993 [JP] Japan ..... 5-137392

[51] Int. Cl.[6] ..... G10H 1/38; G10H 7/00

[52] U.S. Cl. ..... 84/637; 84/613; 84/616

[58] Field of Search ..... 84/613, 616, 637, 84/654, 669

[56] References Cited

U.S. PATENT DOCUMENTS 5,216,188 6/1993 Shibukawa ..... 84/637
5,220,122 6/1993 Shibukawa ..... 84/669
5,403,967 4/1995 Takano ..... 84/613
5,410,098 4/1995 Ito ..... 84/613
5,412,156 5/1995 Ikeda et al. ..... 84/637 X

*Primary Examiner*—William M. Shoop, Jr.
*Assistant Examiner*—Jeffrey W. Donels
*Attorney, Agent, or Firm*—Rossi & Associates

[57] ABSTRACT

In an automatic accompaniment apparatus in which a source pattern produced on a basis of a predetermined chord is memorized so that a tone pitch information of the source pattern is converted in tone pitch in accordance with an input chord designated by a player, a tone pitch conversion information is formed in accordance with an attribute of the tone pitch information and the input chord, and the tone pitch information is converted on a basis of the tone pitch conversion information.

16 Claims, 18 Drawing Sheets

ATBL (STP,NT) CLASSIFICATION TABLE

| STP ↓ | | | PITCH NAME (NT) | | | | | | | | | | | |
|---|---|---|---|---|---|---|---|---|---|---|---|---|---|---|
| | | | C | C# | D | D# | E | F | F# | G | G# | A | A# | B |
| TYPE | 1 | Maj | c1 | n | s | n | c2 | n | n | c3 | n | s | n | n |
| OF | ⋮ | ⋮ | | | | | | ⋮ | | | | | | |
| CHORD | 20 | 7 −9 | c3 | n | c1 | n | n | s | n | c4 | s | n | c2 | n |

Fig. 2

ATBL (STP,NT) CLASSIFICATION TABLE

| STP ↓ | | | PITCH NAME (NT) | | | | | | | | | | | |
|---|---|---|---|---|---|---|---|---|---|---|---|---|---|---|
| | | | C | C# | D | D# | E | F | F# | G | G# | A | A# | B |
| TYPE | 1 | Maj | c1 | n | s | n | c2 | n | n | c3 | n | s | n | n |
| OF | : | : | | | | | | : | | | | | | |
| CHORD | 20 | 7 −9 | c3 | n | c1 | n | n | s | n | c4 | s | n | c2 | n |

Fig. 3 (A)

NTT ( O, TP, NT ) FOR CHORD TONE (c1)(CHORD BACKING)

| TP ↓ | | | PITCH NAME (NT) | | | | | | | | | | | |
|---|---|---|---|---|---|---|---|---|---|---|---|---|---|---|
| | | | C | C# | D | D# | E | F | F# | G | G# | A | A# | B |
| TYPE | 1 | Maj | 0 | −1 | −2 | −3 | −4 | 7 | 6 | 5 | 4 | 3 | 2 | 1 |
| OF | : | : | | | | | | : | | | | | | |
| CHORD | 20 | 7 −9 | 2 | 1 | 0 | −1 | −2 | −3 | −4 | 7 | 6 | 5 | 4 | 3 |

Fig. 3 (B)

NTT ( 5, TP, NT ) FOR CHORD TONE (BASS)

| TP ↓ | | | PITCH NAME (NT) | | | | | | | | | | | |
|---|---|---|---|---|---|---|---|---|---|---|---|---|---|---|
| | | | C | C# | D | D# | E | F | F# | G | G# | A | A# | B |
| TYPE | 1 | Maj | 0 | −1 | 2 | 1 | 0 | −1 | 1 | 0 | −1 | −2 | 2 | 1 |
| OF | : | : | | | | | | : | | | | | | |
| CHORD | 20 | 7 −9 | 0 | 1 | 0 | −1 | −2 | 2 | 1 | 0 | −1 | 1 | 0 | 1 |

Fig. 3 (C)

NTT ( 6, TP, NT ) FOR SCALE TONE (s)

| TP ↓ | | | PITCH NAME (NT) | | | | | | | | | | | |
|---|---|---|---|---|---|---|---|---|---|---|---|---|---|---|
| | | | C | C# | D | D# | E | F | F# | G | G# | A | A# | B |
| TYPE | 1 | Maj | 0 | −1 | 0 | −1 | 0 | −1 | 1 | 0 | −1 | 0 | −1 | 1 |
| OF | ⋮ | ⋮ | | | | | | ⋮ | | | | | | |
| CHORD | 20 | 7 − 9 | 0 | −1 | 0 | −1 | 1 | 0 | −1 | 0 | 0 | −1 | 0 | −1 |

Fig. 3 (D)

NTT ( 7, TP, NT ) FOR NON-SCALE TONE (n)

| TP ↓ | | | PITCH NAME (NT) | | | | | | | | | | | |
|---|---|---|---|---|---|---|---|---|---|---|---|---|---|---|
| | | | C | C# | D | D# | E | F | F# | G | G# | A | A# | B |
| TYPE | 1 | Maj | −1 | 0 | 0 | 0 | −1 | 0 | 0 | −1 | 0 | 0 | 0 | 0 |
| OF | ⋮ | ⋮ | | | | | | ⋮ | | | | | | |
| CHORD | 20 | 7 − 9 | −1 | 0 | −1 | 0 | 0 | 0 | 0 | −1 | 0 | 0 | −1 | 0 |

Fig .9

SCTBL ( MD,TP,DG ) AV SCALE TABLE

MD=0 ( Major ) , TP=0 ( Major )

| DG | FREQUENCY OF ROOT | SCHL | AV SCALE NAME |
|---|---|---|---|
| 0 | I | 0 | Ionian |
| 5 | IV | 1 | Lydian |
| 8 | ♭VI | 2 | Lydian |
| ⋮ | ⋮ | ⋮ | ⋮ |
| OTHER | | $FF_H$ | INDEFINITE |

Fig .10

AVSCHL ( SCHL,NT) CLASSIFICATION TABLE

| NT | 0 | 1 | 2 | 3 | 4 | 5 | 6 | 7 | 8 | 9 | 10 | 11 |
|---|---|---|---|---|---|---|---|---|---|---|---|---|
| SCHL | C | C# | D | D# | E | F | F# | G | G# | A | A# | B |
| 0 | c | n | s | n | c | n | n | c | n | s | n | n |
| 1 | c | n | s | n | c | n | n | c | n | s | n | n |
| 2 | c | n | c | n | n | s | n | c | s | n | c | n |
| ⋮ | | | | | ⋮ | | | | | | | |

Fig .11

NTT ( 0, NT ) CHORD TONE (c)

| PITCH NAME (NT) | | | | | | | | | | | |
|---|---|---|---|---|---|---|---|---|---|---|---|
| C | C# | D | D# | E | F | F# | G | G# | A | A# | B |
| 0 | −1 | −2 | −3 | −4 | 7 | 6 | 5 | 4 | 3 | 2 | 1 |

*Fig. 12*

RSSCHL ( TP, NT ) CLASSIFICATION TABLE

| TP ↓ | | | PITCH NAME (NT) | | | | | | | | | | | |
|---|---|---|---|---|---|---|---|---|---|---|---|---|---|---|
| | | | C | C# | D | D# | E | F | F# | G | G# | A | A# | B |
| TYPE | 1 | Maj | c | n | s | n | c | n | n | c | n | s | n | n |
| OF | : | : | | | | | | : | | | | | | |
| CHORD | 20 | 7 − 9 | c | n | c | n | n | s | n | c | s | n | c | n |

AUTOMATIC ACCOMPANIMENT APPARATUS

BACKGROUND OF THE INVENTION

1. Field of the Invention

The present invention relates to an electronic automatic accompaniment apparatus for harmonizing automatic accompaniment with performance of a player on a basis of a preliminarily memorized accompaniment pattern and/or an accompaniment pattern selected by the player.

2. Description of the Prior Art

In a conventional automatic accompaniment apparatus of this kind, various kinds of accompaniment patterns are memorized in accordance with each style of musical tune such as rock music, country music or the like. In operation of the accompaniment apparatus, an accompaniment pattern is selected from the memorized accompaniment patterns by operation of a player to automatically harmonize the selected accompaniment with an input chord applied from a keyboard. In general, the accompaniment patterns each are composed of a set of tone pitch data indicative of each tone pitch of accompaniment tones and timing data indicative of a sound timing. The tone pitch data is represented by key-codes on a basis of predetermined chords such as C Major or the like and is produced as a source pattern taking into account of tone pitch conversion effected in accordance with the type and root of the input chord. In operation of the accompaniment apparatus, the key-codes of the source pattern are converted in tone pitch in accordance with the type of the input chord applied from the keyboard, and all the converted tone pitches are shifted in accordance with the root of the input chord to produce an accompaniment tone at a tone pitch harmonized with the input chord.

In addition, the shift data of the key-codes is memorized as a note conversion table in accordance with the type of the input chord to convert the source pattern in tone pitch in compliance with the type of the input chord. Thus, the shift data is read out from the note conversion table in compliance with the type of the input chord and calculated as the key-code of the source pattern to obtain a suitable accompaniment pattern in accordance with the type of the chord.

The accompaniment pattern includes, however, ornamental tones other than the chord constituent notes. It is, therefore, required to convert the ornamental tones in tone pitch in accordance with the kind of the accompaniment pattern in order to obtain an optimal accompaniment pattern. As a result, a producer of the pattern is forced to produce the note conversion table for each source pattern or each kind of accompaniment patterns for effecting the tone pitch conversion.

SUMMARY OF THE INVENTION

It is, therefore, a primary object of the present invention to provide an electronic automatic accompaniment apparatus wherein it is not required to produce the note conversion table for each source pattern.

According to the present invention, the primary object is accomplished by providing an automatic accompaniment apparatus in which a source pattern produced on a basis of a predetermined chord is memorized so that a tone pitch information of the source pattern is converted in tone pitch in accordance with an input chord, the accompaniment apparatus comprising determination means for determining an attribute of the tone pitch information of the source pattern; means for forming a tone pitch conversion information in accordance with the attribute and the input chord; and tone pitch conversion means for converting the tone pitch information on a basis of the tone pitch conversion information.

According to an aspect of the present invention, there is provided an automatic accompaniment apparatus in which a source pattern produced on a basis of a predetermined chord is memorized so that a tone pitch information of the source pattern is converted in tone pitch in accordance with an input chord, the accompaniment apparatus comprising input means for inputting a tonality information; determination means for determining an attribute of the tone pitch information of the source pattern; means for producing a tone pitch conversion information on a basis of the attribute, the input chord and the tonality information; and tone pitch conversion means for converting the tone pitch information of the source pattern on a basis of the tone pitch conversion information.

According to another aspect of the present invention, there is provided an automatic accompaniment apparatus in which a source pattern produced on a basis of a predetermined chord is memorized so that a tone pitch information of the source pattern is converted in tone pitch in accordance with an input chord, the accompaniment apparatus comprising input means for inputting a performance information; detection means for detecting a tonality of the performance information; determination means for determining whether the tonality has been detected or not; first production means for producing a first tone pitch conversion information on a basis of the attribute, the input chord and the tonality information when the tonality has been detected; second production means for producing a second tone pitch conversion information on a basis of the attribute and the input chord when the tonality has not been detected; and tone pitch conversion means for converting the tone pitch information of the source pattern on a basis of the first and second tone pitch conversion information.

BRIEF DESCRIPTION OF THE DRAWINGS

Additional objects, features and advantages of the present invention will be more readily appreciated from the following detailed description of a preferred embodiment thereof when taken together with reference to the accompanying drawings, in which:

FIG. 2 illustrates an example of a classification table adapted to the accompaniment apparatus;

FIGS. 3(A) to 3(D) each illustrate a note conversion table;

FIG. 9 illustrates an example of an AV scale table adapted to a modified control program;

FIG. 10 illustrates an example of a classification table in compliance with an AV scale;

FIG. 11 illustrates an example of a note conversion table;

FIG. 12 illustrates a classification table in compliance with the root of a chord;

DESCRIPTION OF THE PREFERRED EMBODIMENT

Figure 1:
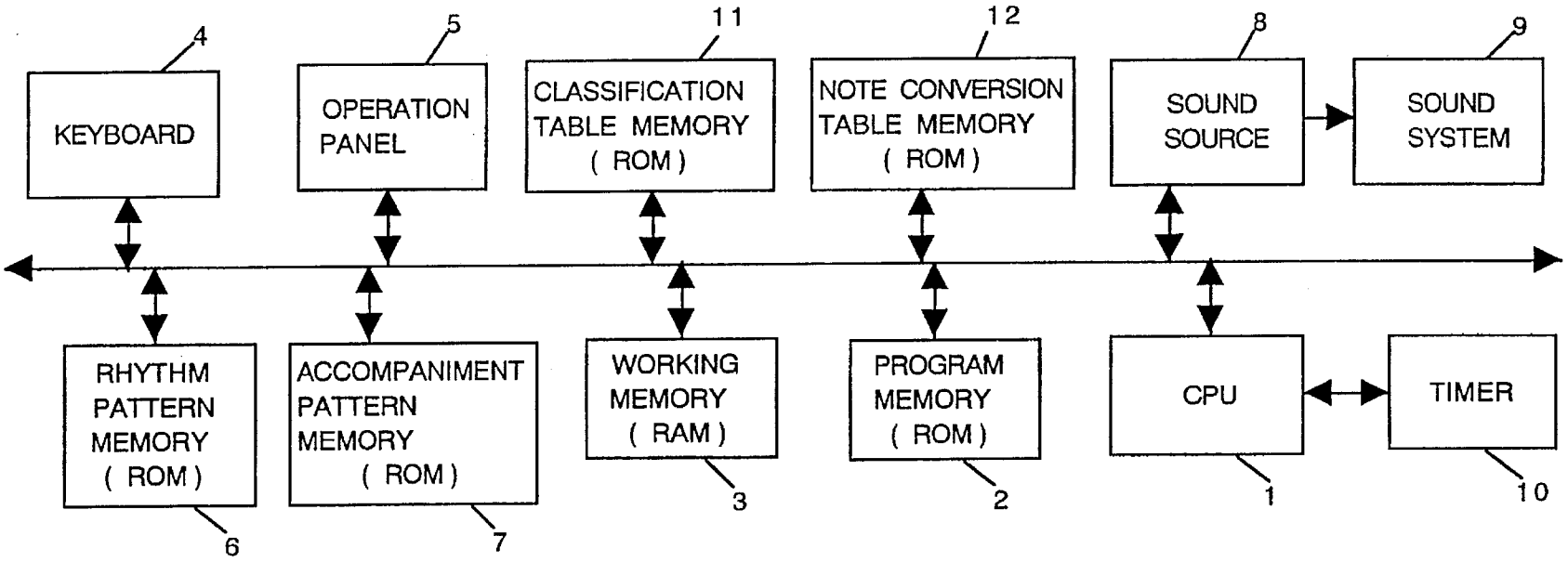
FIG. 1 is a block diagram of an electronic musical instrument provided with an automatic accompaniment apparatus in accordance with the present invention.

In FIG. 1 of the drawings, there is schematically illustrated a block diagram of an electronic musical instrument provided with an automatic accompaniment apparatus in accordance with the present invention. The electronic musical instrument includes a central processing unit or CPU 1 arranged to use a working area of a working memory 3 for executing a control program stored in a program memory 2 in the form of a read-only memory or ROM thereby to effect performance played on a keyboard 4, mode selection conducted by operation of an operation panel 5 and processing of input data. The automatic accompaniment apparatus is designed to effect automatic accompaniment based on accompaniment patterns respectively memorized in a rhythm pattern memory 6 and an accompaniment pattern memory 7.

The CPU 1 detects a key event of the keyboard 4 and is applied with a key code indicative of the key event and a key-on signal or a key-off signal. Thus, the CPU 1 applies the key-code with a note-on or a note-off to a sound source 8 for generation or mute of a musical sound in response to the keyboard performance. The sound source 8 is arranged to produce a musical tone signal in accordance with the number of a percussion instrument for generating an accompaniment tone of the input key-code and the memorized rhythm pattern. The musical tone signal is applied to a sound system 9 where it is converted into an analog signal and amplified to be generated as a musical sound.

The CPU 1 is associated with a timer 10 which is applied with an information of tempo designated by operation of the operation panel 5 to generate an interruption signal twelve times at each 8th note in response to the tempo applied from the CPU 1. Thus, the CPU 1 executes interruption processing for automatic accompaniment in response to the interruption signal.

The keyboard 4 is imaginarily divided into a left-hand key area for lower tones and a right-hand key area for higher tones. When the automatic accompaniment is effected, the CPU 1 is responsive to a key event on the right-hand key area to execute processing for generation of a musical tone and processing for mute of the musical tone and is responsive to a key event on the left-hand key area to detect a chord based on the detected key-code.

The operation panel 5 is provided with various switches such as a pattern selection switch for selecting an accompaniment pattern or a rhythm pattern, a start/stop switch for designating start or stop of the automatic accompaniment, a pattern input switch for designating an input mode of an accompaniment pattern or a rhythm pattern selected by a player and other switches. When the switches on the operation panel 5 are operated, the CPU 1 detects each operation event of the switches to execute processing designated by the operation event. In addition, the rhythm pattern memory 8 and accompaniment pattern memory 7 are arranged to respectively memorize plural kinds of rhythm patterns and accompaniment patterns and to memorize the rhythm pattern and accompaniment pattern designated by the input mode. These rhythm patterns and accompaniment patterns are selected by operation of the pattern selection switch and memorized as a pattern number (PTN).

In this embodiment, the accompaniment patterns each include a chord pattern composed of three parts of a chord backing 1–3 corresponding with various chord tones such as arpeggio or the like and a bass pattern corresponding with a bass tone. These chord backing 1–3 and bass pattern each are designated as a part number (PRT=0–3). At each part of the accompaniment patterns, a set of data indicative of the key-code, timing, key-on or key-off is memorized in sequence. At the rhythm pattern, a set of the number of the percussion instrument and the timing data is memorized in sequence.

As shown in the following table 1, a plurality of scales are determined with respect to each type of chords. At the respective scales, a chord constituent note is determined as a chord tone (c), a tone on the scale other than the chord constituent note is determined as a scale tone (s), and a tone other than the scale tone is determined as a non-scale tone (n). Thus, the attributes (c, s, n) are determined in relation to the pitch names (C, C#, D, D#, . . . ).

TABLE 1

| Type of chord | Scale name | C C# | D D# | E F F# | G G# | A A# | B |
|---|---|---|---|---|---|---|---|
| Major | Ionian | c n | s n | c s n | c n | s n | s |
| | Lydian | c n | s n | c n s | c n | s n | s |
| | Mixolydian | c n | s n | c s n | c n | s s | n |
| | result | c n | s n | c n n | c n | s n | n |

. . .

TABLE 1-continued

| Type of chord | Scale name | C C# | D D# | E F F# | G G# | A A# | B |
|---|---|---|---|---|---|---|---|
| 7–9 | Mixolydian | c n | c n | c s s | c s | s c | n |
| | Aeolian | c n | c c | n s n | c s | n c | n |
| | result | c n | c n | n s n | c s | n c | n |

Thus, the key code of the source pattern for automatic accompaniment is classified in accordance with the attributes of the chord. When the detected chord is converted in tone pitch in accordance with the attributes thereof based on a note conversion table, a musically optimal tone pitch conversion is effected regardless of the kind of the accompaniment pattern.

As is understood from the table 1, the attributes are different in accordance with a difference in scale in spite of the fact that the chord is the same in its type and tone pitch. Accordingly, in the case that the attributes at all the scales in the type of the same chord becomes the same in each pitch name, the attributes are determined for the tone pitch conversion. In the case that the attributes at all the scales in the type of the same chord are different, the attributes are determined as a non-scale tone if one of the attributes is a non-scale tone (n). In this instance, there is not any mixture of the chord tone and the scale tone.

When the attributes are determined as described above, the attributes of each pitch name relative to each type of the chords is determined as shown by the column "result" in the table 1. Thus, a classification table corresponding with one attribute related to the type and pitch name of the chord is obtainable.

In FIG. 2 there is illustrated an example of the classification table obtained in such a manner as described above. In the classification table, chord tones (c1–c4), scale tone (s) and non-scale tone (n) related to respective pitch names (C, C#, D, #, . . . ) are classified in accordance with each type (TP) of the chords. In this embodiment, the attributes "c1–c4" of the chord tone are classified in sequence taking into account of the priority for formation of the chord backing. The numeral added to the chord is determined in such a manner that an important pitch name for formation of the chord backing is represent by a small numeral. In addition, each of the two attributes (c1–c4, s, n) is memorized as a classification table ATBL (TP, NT) in a classification table memory 11 by means of an array register where the type of the chord TP and a note code NT each are applied as an argument.

In FIGS. 3(A) to 3(D) there are illustrated an example of the note conversion table wherein shift data (0, −1, −2, . . . ) of the key-code are memorized in an array register where an index (AT) related to the attributes, the type of the chord (TP) and the note code (NT) each are applied as an argument. The note conversion table is memorized as NTT(AT, TP, NT) in the note conversion table 12. In this embodiment, FIG. 3(A) illustrates a note conversion table used for tone pitch conversion of the chord backing when the attribute is a chord tone. FIG. 3(B) illustrates a note conversion table used for tone pitch conversion of the bass when the attribute is a chord tone. FIG. 3(C) illustrates a note conversion table used when the attribute is a scale tone. FIG. 3(D) illustrates a note conversion table used when the attribute is a non-scale tone.

In operation of the automatic accompaniment apparatus, the CPU 1 reads out a key-code of a currently selected accompaniment pattern from the accompaniment pattern memory 7 and refers to the classification table in the classification table memory 11 on a basis of a note code defined by the key code to classify the key code in accordance with the type of the chord in the source pattern into either one of the chord tone, scale tone and non-scale tone. Thus, the CPU 1 refers to the note conversion tables in the note conversion table memory 12 on a basis of the classification to effect tone pitch conversion of the key code.

In this embodiment, desired accompaniment pattern and rhythm pattern can be applied as a source pattern by the player in the following manner. In this instance, the pattern selection switch on the operation panel 5 is operated by the player to select a pattern number other than the pattern number of a preset pattern. Subsequently, an accompaniment pattern and a rhythm pattern are applied by designation of a part of the accompaniment pattern and performance played on the keyboard 4, and the type and root of the chord in the applied accompaniment pattern is applied. The applied accompaniment pattern and rhythm pattern are alloted with the pattern number and memorized respectively in the accompaniment pattern memory 7 and rhythm pattern memory 6 to effect automatic accompaniment designated by the pattern number in the same manner as in the preset pattern.

Figure 4:
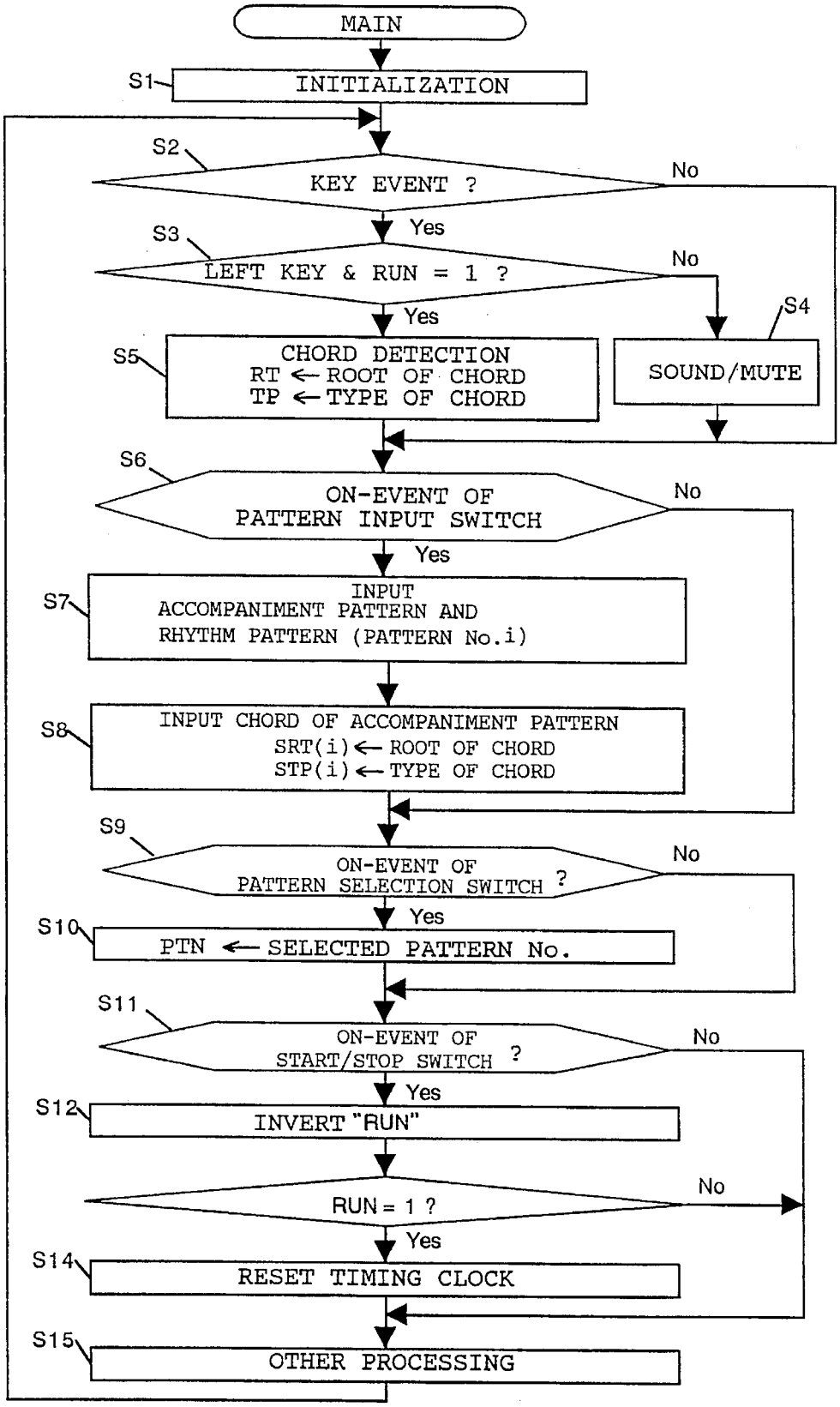
FIG. 4 is a flow chart of a main routine of a control program to be executed by a central processing unit shown in FIG 1.
Figure 5:
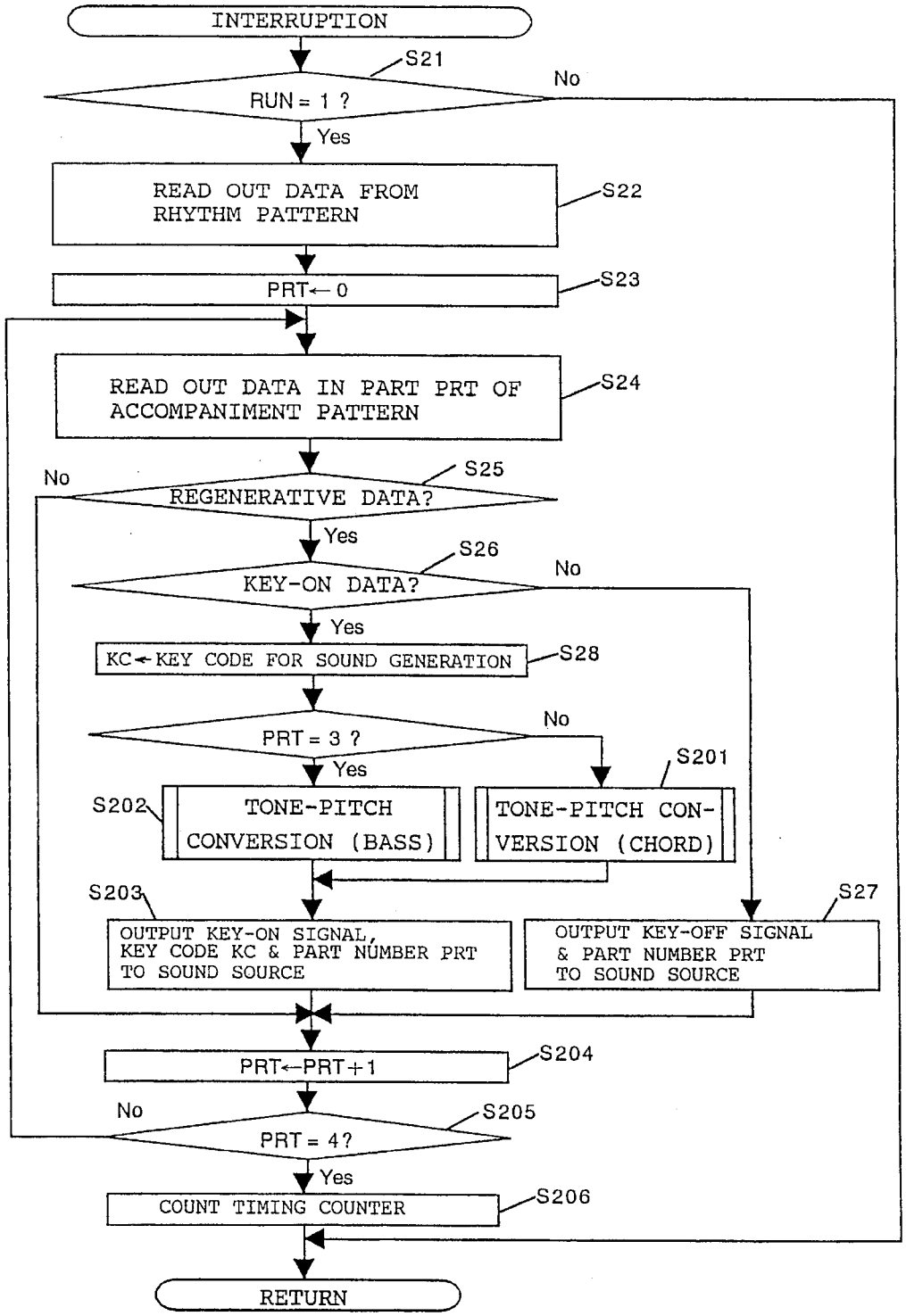
FIG. 5 is a flow chart of an interruption routine of the program.
Figure 6:
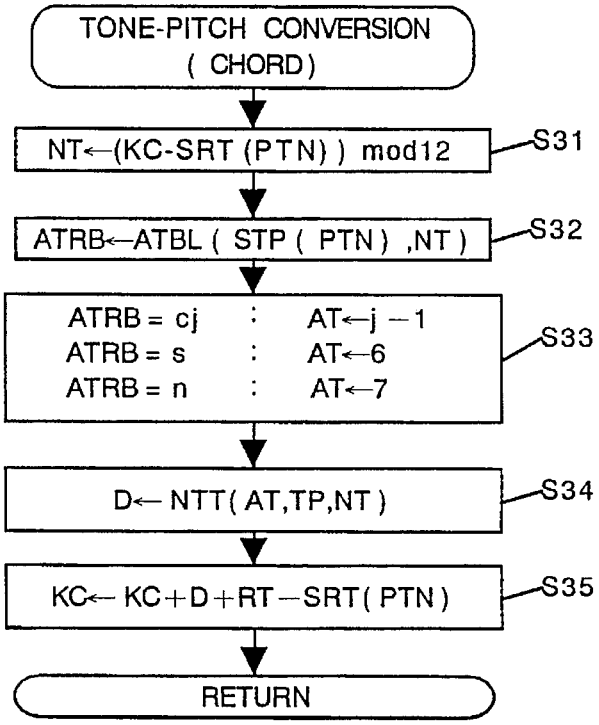
FIG. 6 is a flow chart of a subroutine for tone pitch conversion of a chord pattern.
Figure 7:
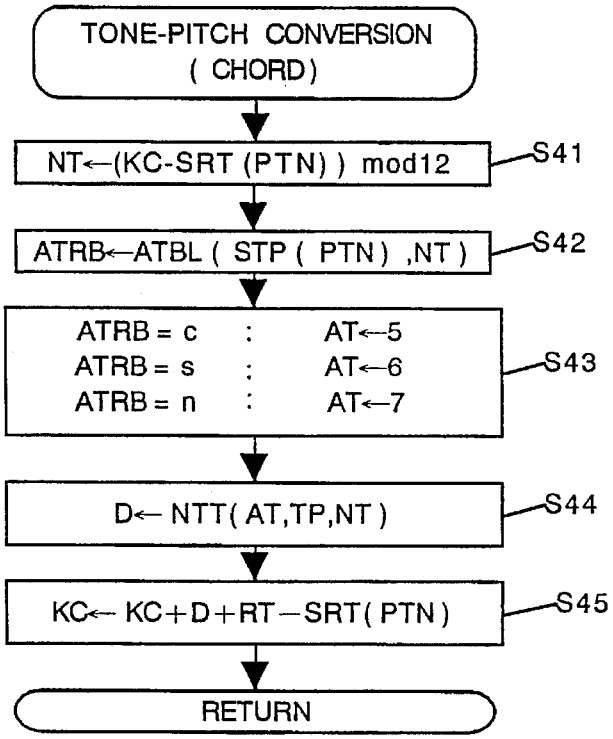
FIG. 7 is a flow chart of a subroutine for tone pitch conversion of a base pattern.

In FIG. 4 there is illustrated a flow chart of a main routine of the control program. In FIGS. 5 to 7 there is illustrated each flow chart of an interruption routine and subroutines of the control program. Hereinafter, the operation of the embodiment will be described with reference to the flow charts. Besides, respective registers and flags used in the flow charts are represented by the following labels.

RT: Root of a detected chord,

TP: Type of the detected chord,

SRT(1): Root of a chord in a source pattern of pattern number "1",

STP(1): Type of the chord in the source pattern of pattern number "1",

RUN: Flag indicative of start/stop of automatic accompaniment,

PTN: Pattern number of an accompaniment pattern and a rhythm pattern,

PRT: Part number indicative of a part of the accompaniment,

KC: Key-code,

NT: Note-code,

ATBL(k, m): Classification table,

ATRB: Classified attributes,

NTT (p, k, m): Note conversion table,

AT: Index for corresponding the attributes with the note conversion table,

D: Shift data of the note conversion table.

When connected to an electric power source, the CPU 1 is activated to initiate execution of the main routine shown in FIG. 4. At step S1, the CPU 1 initializes respective flags and variables in registers and causes the program to proceed to step S2 where the CPU 1 determines presence of a key event on the keyboard 4. If there is not any key event, the CPU 1 causes the program to proceed to step S6. If a key event is present, the program proceeds to step S3 where the CPU 1 determines whether the key event is in the left-hand key area or not and determines whether the flag RUN is "1" or not. If the answer at step S3 is "No", the program proceeds to step S4 where the CPU 1 executes a processing for generation or mute of a musical tone and causes the program to proceed to stop S6. If the answer at step S3 is "Yes", the program proceeds to step S5 where the CPU 1 detects a chord based a key-code of the key event to store the root RT and type TP of the detected chord in the register and causes the program to proceed to step S6.

At step S6, the CPU 1 determines whether an on-event of the pattern input switch on the operation panel 5 is present or not. If the answer at step S6 is "No", the program proceeds to step S9. If the answer at step S6 is "Yes", the program proceeds to step S7 where the CPU 1 executes input processing of a pattern number, an accompaniment pattern and a rhythm pattern respectively selected by the player and memorizes them as an input pattern number "1" respectively in the accompaniment pattern memory 12 and rhythm pattern memory 11. Subsequently, the CPU 1 executes at step S8 input processing of a chord of the selected accompaniment pattern to store the root SRT(1) and type STP (1) of the chord in the register and causes the program to proceed to step S9.

At step S9, the CPU 1 determines whether an on-event of the pattern selection switch on the operation panel 5 is present or not. If the answer at step S9 is "No", the program proceeds to step S11. If the answer at step S9 is "Yes", the program proceeds to step S10 where the CPU 1 stores the number PTN of the selected pattern in the register and causes the program to proceed to step S11. At step S11, the CPU 1 determines whether an on-event of the start/stop switch on the operation panel 5 is present or not. If the answer at step S11 is "No", the program proceeds to step S15. If the answer at step S11 is "Yes", the CPU 1 inverts the flag RUN at step S12 and determines at step S13 whether the flag RUN is "1" is not. If a stop is designated in a condition for automatic accompaniment, the CPU 1 determines a "No" answer at step S13 and causes the program to proceed to step S15. If a start is designated in a condition for automatic accompaniment, the CPU 1 determines a "Yes" answer at step S13, resets a timing clock at step S14 and causes the program to proceed to step S15. At step S15, the CPU 1 executes processing for selection of a tone color or the like and returns the program to step S2 for repeating the execution of the main routine.

When applied with an interruption signal from the timer 10, the CPU 1 executes the interruption routine shown in FIG. 5. At step S21 of the interruption routine, the CPU 1 determines whether the flag RUN is "1" or not. If the answer at step S21 is "No", the program returns to the main routine. If the answer at step S21 is "Yes", the program proceeds to step S22 where the CPU 1 reads out date (a musical instrument number) corresponding with the current timing clock in the rhythm pattern of the pattern number PTN and applies the data to the sound source 8 for generating a musical sound therefrom. At the following step S23, the CPU 1 sets the part number PRT of a part in the accompaniment pattern as "0" an repeats processing for each part of the chord backing 1–3 and bass pattern on a basis of processing for increment of the part number PRT at step S204 and determination at step 205 as described below.

At step S24, the CPU 1 reads out data corresponding with the current timing clock in the part PRT of the accompaniment pattern designated by the pattern number PTN and determines at step S25 whether a respective data is present or not. If the answer at step S25 is "No", the program proceeds to step S204. If the answer at step S25 is "Yes", the program proceeds to step S26 where the CPU 1 determines whether the regenerative data is a key-on data or not. If the answer at step S26 is "No", the program proceeds to step S27 where the CPU 1 applies a key-off signal and the part number PRT of the accompaniment pattern to the sound source 8 for muting. If the answer is step S26 is "Yes", the program proceeds to step S28 where the CPU 1 stores a key-code KC for sound generation as a read-out data of the accompaniment pattern in the register and causes the program to proceed to step S29. At step S29, the CPU 1 determines whether the part number PRT of the accompaniment pattern is "3" indicative of a part of the bass pattern or not.

If the part number PRT is not "3", it represents regeneration of the chord pattern (chord backing 1–3: PRT=0, 1, 2). In such an instance, the program proceeds to step S201 where the CPU 1 executes processing for tone pitch conversion of the chord pattern shown in FIG. 6. If the part number PRT is "3", it represents regeneration of the bass pattern. In such an instance, the program proceeds to step S202 where the CPU 1 executes processing for tone pitch conversion of the bass pattern. After execution of the processing for tone pitch conversion of the chord pattern or the bass pattern, the CPU 1 applies at step 203 the key-on signal, the key-code KC and the part number PRT of the accompaniment pattern to the sound source 8 for generation of a musical sound. When the program proceeds to step S204, the CPU 1 adds "1" to the part number PRT of the accompaniment pattern and causes the program to proceed to step S205 where the CPU 1 determines whether the part number PRT is "4" or not. If a regenerative part remains in the accompaniment pattern, the CPU 1 determines a "No" answer at step S205 and returns the program to step S24 for further execution of processing at step S24 to S205. If all the parts of the accompaniment pattern are regenerated, the CPU 1 determines a "Yes" answer at step S205 and causes the program to proceed to step S206 where the CPU 1 causes the timing counter to count the part number PRT and returns the program to the main routine.

In execution of the processing for tone pitch conversion of the chord pattern shown in FIG. 6, the CPU 1 shifts at step S31 the key-code of the read out data in tone pitch in accordance with the root SRT of the chord of the accompaniment pattern number PTN to store the shifted key-code as a note code NT in the register and causes the program to proceed to step S32. At step S32, the CPU 1 stores a data ATBL (STP (PTN), NT) of a classification table indicative of the type STP of the chord of the accompaniment pattern number PTN and the note code NT as an attribute ATRB in the register. At the following step S33, the CPU 1 sets "j–1" as an index AT when the attributes ATRB is "cj" (a chord tone), sets "6" as the index AT when the attribute ATRB is "s" (a scale tone) and sets "7" as the index AT when the attribute ARRB is "n" (a non-scale tone). Thus, the note conversion table of the chord pattern is selected in accordance with the attribute ATRB. When the program proceeds to step S34, the CPU 1 reads out a shift data D corresponding with the type TP of the detected chord and the note code NT from the selected note conversion table NTT (AT, TP, NT) and stores the shift data D in the register. At the following step S35, the CPU 1 adds the shift data D and the root RT of the detected chord to the key-code KC of the data read out from the chord pattern and subtracts the root SRT of the chord in the current accompaniment pattern (PTN) from a resultant of an addition to convert the key-code KC in tone pitch. Thereafter, the program returns to the main routine.

In execution of the processing for tone pitch conversion of the base pattern shown in FIG. 7, the CPU 1 shifts at step S41 the key-code KC of the read out data in tone pitch in accordance with the root SRT (PTN) of the chord of the accompaniment pattern number PTN to store the shifted key-code as a note code NT in the register. Subsequently, the CPU 1 stores at step S42 a data ATBL (STP, (PTN), NT) of the classification table as an attribute ATRB in the register. At the following step S43, the CPU 1 sets "5" as an index AT when the attribute ATRB is "c" (c1, c2, . . . cj) at the chord tone), sets "6" as the index AT when the attribute ATRB is "s" (a scale tone) and sets "7" as the index AT when the attribute ATRB is "n" (a non-scale tone). Thus, the note conversion table of the bass pattern is selected in accordance with the attribute ATRB. When the program proceeds to step S44, the CPU 1 reads out a shift data D corresponding with the type TP of the detected chord and the note code NT from the note conversion table NTT (AT, TP, NT) to store the shift data D in the register. At the following step S45, the CPU 1 converts the key-code KC of the read out data in tone pitch on a basis of the shift D, the root RT of the detected chord and the root SRT (PTN) of the chord of the accompaniment pattern number PTN and returns the program to the main routine.

Figure 8:
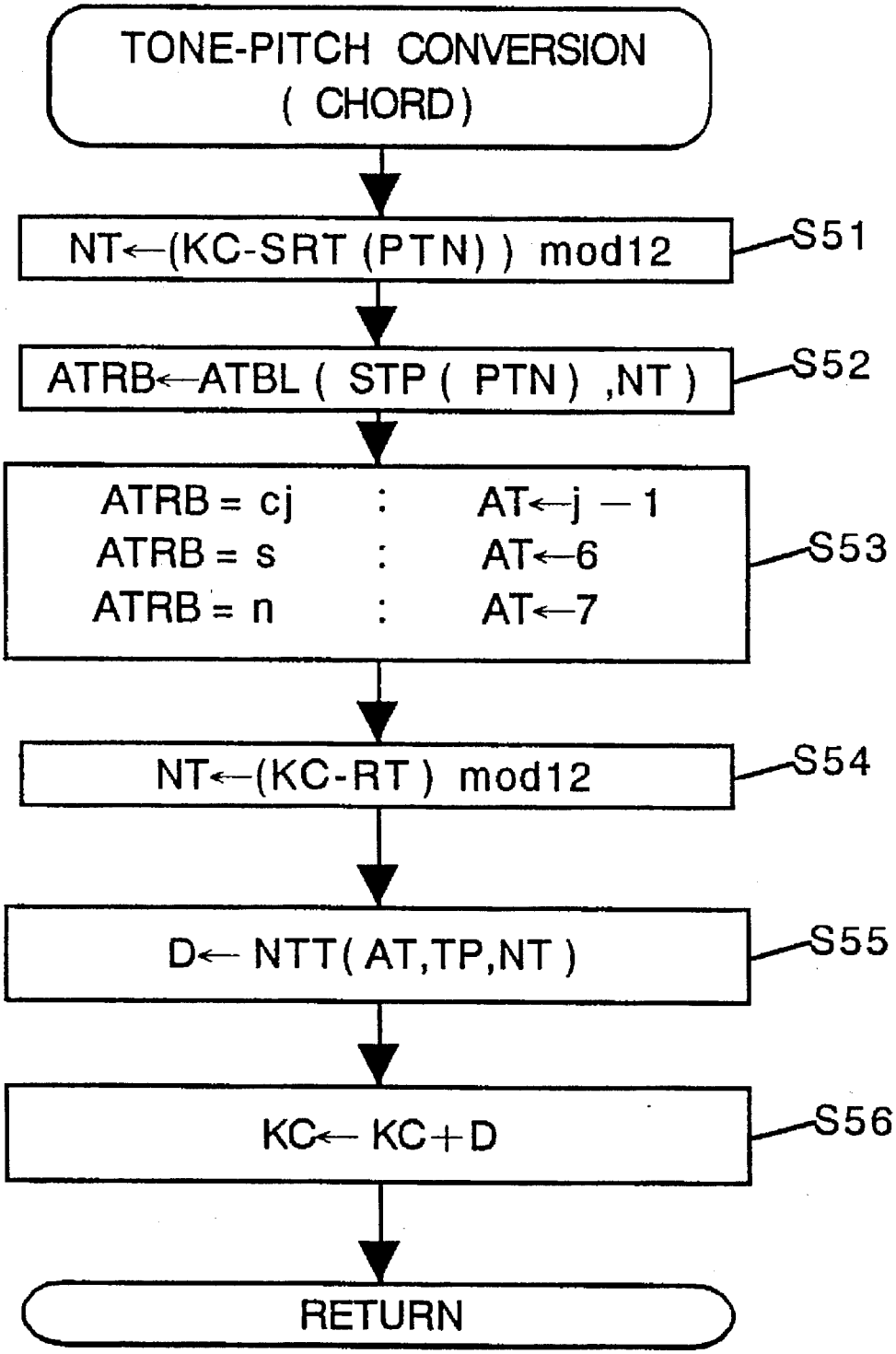
FIG. 8 is a flow chart of a modification of the subroutine shown in FIG. 6.

Although in the processing for tone pitch conversion of the chord pattern, the root shift has been made at step S35 on a basis of the root RT of the detected chord and the root SRT of the chord in the accompaniment pattern, the processing for tone pitch conversion of the chord pattern may be executed as shown in FIG. 8. At step S51 to S53 in FIG. 8, the same processing as that at step S31 to S33 in FIG. 6 is executed. At step S54, the CPU 1 shifts the key-code KC of the read out data in tone pitch in accordance with the root RT of the detected chord to store the shifted key-code as a note code NT in the register. At the following step S55, the CPU 1 read out a shift data D corresponding with the type TP of the detected chord and the note code NT from the selected note conversion table and stores the shift data D in the register. When the program proceeds to step S56, the CPU 1 converts the chord pattern in tone pitch by adding the shift data D to the key-code of the read out data and returns the program to the main routine.

As is understood from the foregoing description, the shift data D is added to the read out key-code so that the attribute of the key-code KC of the source pattern becomes an attribute of the scale determined by the root and type of the detected chord corresponding thereto. Accordingly, a final shift of the root to the key-code is not required. Thus, the tone pitch of the accompaniment pattern becomes natural without any change in the entirety of the patterns.

As described above, the key-code of the read out data of the accompaniment pattern is classified into any one of the chord tone, scale tone and non-scale tone on a basis of the note code and the type of the chord in the accompaniment pattern (the source pattern), and the tone pitch conversion is effected on a basis of the note conversion table determined by a result of the classification. As is understood from the note conversion table shown in FIGS. 3(A) to 3(D), the chord tone is converted into a chord tone, the scale tone is converted into a chord tone or a scale tone, and the non-scale tone is converted into a scale tone or a non-scale tone.

That is to say, the key-code of the accompaniment pattern is classified in accordance with attributes of the pitch names on the scale defined by the type of the chord such as the chord tone, scale tone and non-scale tone, and the tone pitch conversion is effected in accordance with the respective attributes on a basis of the note conversion table. Accordingly, even if different accompaniment patterns are converted by the same note conversion table, the accompaniment patterns can be converted into a tone pitch suitable thereto in a musical sense. Although in the embodiment the attribute has been composed of the chord tone, scale tone and non-scale tone, the chord tone may be further classified into a root and others.

Hereinafter, a modification of the above-described embodiment will be described with reference to FIGS. 9 to 21. In this modification, the scale adapted to the type of the chord is referred to an available or AV scale. The AV scale is determined respectively in relation to a tonality and a chord. That is to say, the AV scale is determined in relation to the mode of the tonality (C minòr/C major), the type of the chord, the tonic of the tonality and the root of the chord. Thus, the AV scale is obtained from an AV scale table on a basis of a chord information of a source pattern for automatic accompaniment and a tonality information applied by a player, and a note conversion table is produced in accordance with an attribute of a pitch name related to the AV scale. The key code of the source pattern for automatic accompaniment is classified by the attribute to effect tone pitch conversion of a detected chord on a basis of the note conversion table related to the attribute. With such an arrangement, the tone pitch conversion can be effected in an optimal manner in a musical sense regardlessly of the kind of the accompaniment pattern.

In FIG. 9 there is illustrated an AV scale table which is memorized in the classification table memory 11 to obtain an AV scale based on a chord information and a tonality information. The AV scale table is designed to store a corresponding scale number SCHL in an array register where a frequency data DC corresponding with the number of the root of the chord is applied as an argument when tonality mode MD, a type TP of a chord and the tonic of the tonality are referenced. In FIG. 10 there is illustrated a classification table which represents the attribute of pitch names related to the AV scale in this modification. The classification table is arranged to allot a chord tone (c), a scale tone (s) and a non-scale tone (n) to respective pitch names (C, C#, D, C#, . . . ) in relation to each scale number SCHL. Attributes respectively represented by the chord tone (c), the scale tone (s) and the non-scale tone (n) are memorized as a classification table AVSCHL (SCHL, N) in the classification table memory 11 by means of an array register where each scale number SCHL of the AV scale and a note code N are adapted as an argument.

In FIG. 11 there is illustrated a note conversion table NTT (AT, N) which is memorized in the note conversion table 12. The note conversion table is produced to memorize a shift data (0, −1, . . . ) of the key-code in an array register where an index (AT) indicative of the attribute and the note node (N) are applied as an argument. In the note conversion table shown in FIG. 4, the attribute is represented by the chord tone for tone pitch conversion of the chord backing.

When applied with a tonality information by setting or automatic detection thereof, the CPU 1 executes processing for automatically forming the note conversion table NTT (AT, N). In this instance, the CPU 1 obtains a scale number SCHL from the frequency data DG of the root of the chord with reference to the AV scale table SCTBL (MD, TP, DG) and refers to the classification table AVSCHL (SCHL, N) based on the scale number SCHL to automatically produce the note conversion table NTT (AT, N) in accordance with the attribute.

In automatic accompaniment, the CPU 1 reads out the key code of the currently selected accompaniment pattern from the accompaniment memory 7 and obtains the scale number SCHL based on the tonality information and chord information of the source pattern. Thus, the CPU 1 refers to the classification table AVSCHL (SCHL, N) on a basis of the note code NT corresponding with the scale number SCHL and the key code to classify the key-code into either one of the attributes respectively indicative of the chord tone, the scale tone and the non-scale tone. Subsequently, the CPU 1 obtains a shift data corresponding with the note code NT from the note conversion table NTT corresponding with the attribute and converts the key code of the accompaniment pattern on a basis of the shift data. In the case that the tonality information may not be obtained of the AV scale is indefinite, the CPU 1 produces a note conversion table in accordance with the attribute of the pitch name corresponding with the type of the chord in the source pattern to effect tone pitch conversion of the note conversion table without using the tonality information.

As is understood from the table 1, the attribute is different in accordance with a difference in scale in spite of the fact that the chord is the same in its type and tone pitch. Accordingly, in the case that the attribute at all the scales in the type of the same chord becomes the same in each pitch name, the attribute is determined as it is. In the case that plural attributes at all the scales in the type of the same chord are different, a non-scale tone is determined if one of the attributes is a non-scale tone (n). In this instance, there is not any mixture of the chord tone and the scale tone.

When the attribute is determined in such a manner as described above, the attribute of each pitch name relative to each type of the chords is determined as shown by the column "result" in the table 1. Thus, a classification table corresponding with one attribute related to the type and pitch name of the chord is obtainable. In FIG. 12 there is illustrated the classification table produced as described above, wherein the respective attributes (c, s, n) are memorized as a classification table RSSCHL (TP, N) in the classification memory 11 by means of an array register where the type of the chord and the note code are applied as an argument.

In operation of the automatic accompaniment apparatus, the CPU 1 reads out a key-code of a currently selected accompaniment pattern from the accompaniment pattern memory 7 and refers to the classification table RSSCHL (TP, N) on a basis of the note code N corresponding with the key code and the type of the chord TP in the source pattern to classify the key code into either one of the chord tone, scale tone and non-scale tone. Thus, the CPU 1 refers to the note conversion table on a basis of the classification to obtain a shift data corresponding with the note code NT for effecting tone pitch conversion of the key code.

In this modification, desired accompaniment pattern and rhythm pattern can be applied as a source pattern by the player in the following manner. In this instance, the pattern selection switch on the operation panel 5 is operated by the player to select a pattern number other than the pattern number of a preset pattern. Subsequently, an accompaniment pattern and a rhythm pattern are applied by designated of a part of the accompaniment pattern and performance played on the keyboard 4, and the type and root of the chord in the applied accompaniment pattern are applied. Additionally, the tonality of the accompaniment pattern is also applied. The applied accompaniment pattern and rhythm pattern are alloted with the pattern number and memorized respectively in the accompaniment pattern memory 7 and rhythm pattern memory 6 to effect automatic accompaniment designated by the pattern number in the same manner as in the preset pattern.

Figure 13:
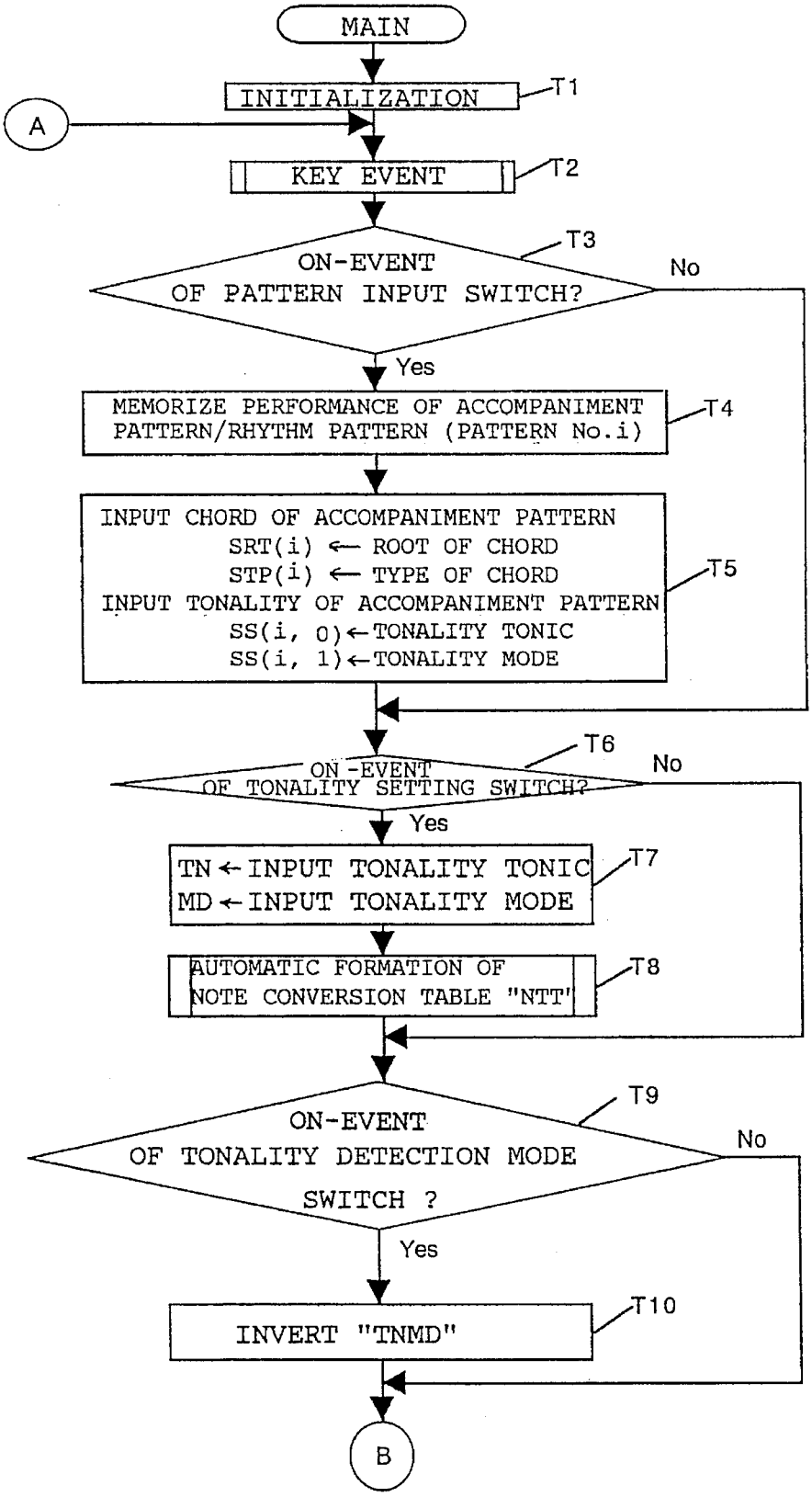
FIG. 13 is a flow chart of a portion of a main routine of the modified control program.
Figure 14:
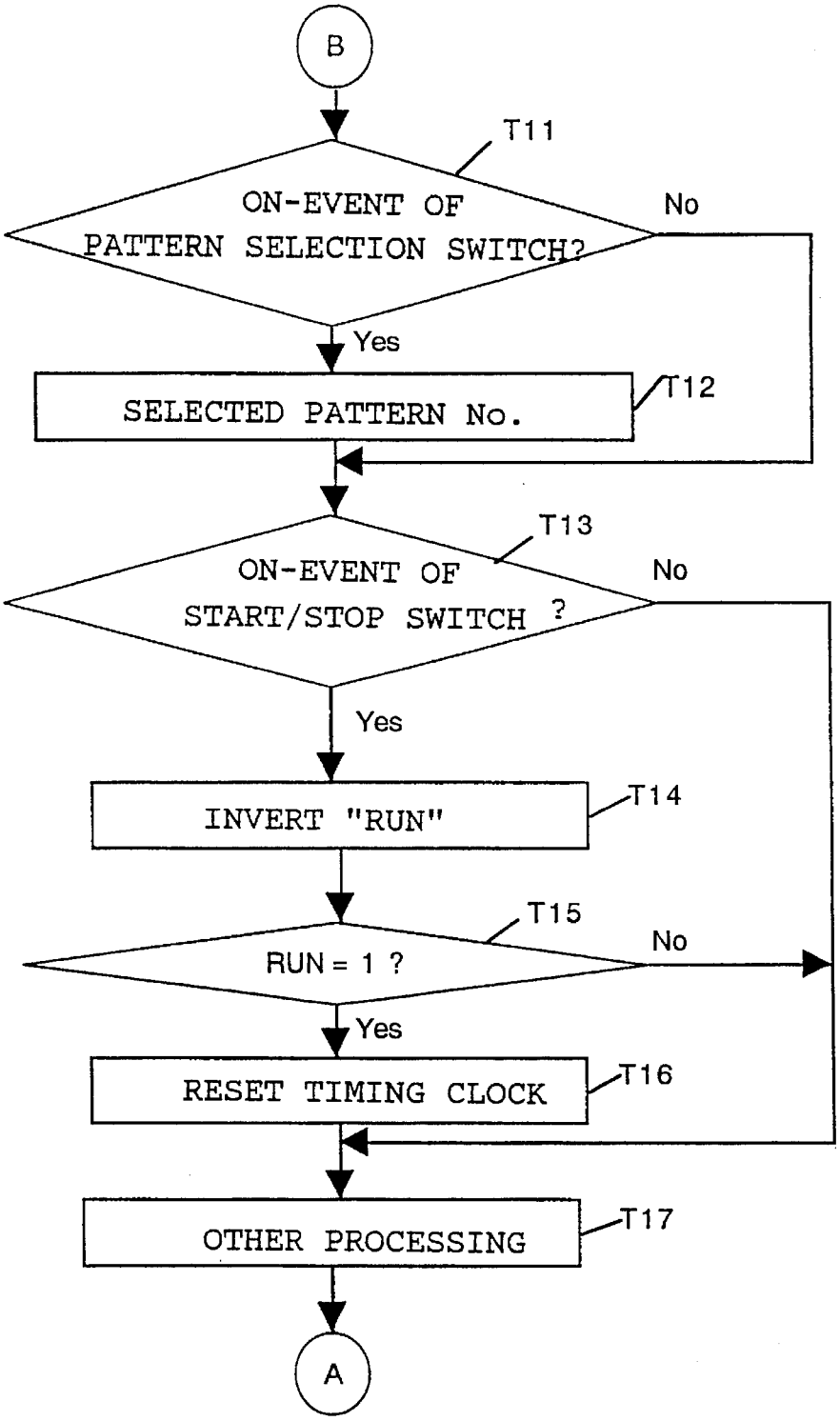
FIG. 14 is a flow chart of the remaining portion of the main routine.

In FIGS. 13 and 14 there is illustrated a flow chart of a main routine of a control program in this modification. In FIGS. 15 to 21 there is illustrated each flow chart of an interruption routine and subroutines of the control program. Hereinafter, the operation of the modification will be described with reference to the flow charts. Besides respective registers and flags used in the flow charts are represented by the following labels.

TN: Tonic of input tonality,
MD: Mode of the input tonality,
RT: Root of a detected chord,
TP: Type of the detected chord,
SS (1, 0): Tonic of a tonality in a source pattern of pattern number "1",
SS (1, 1): Mode of the tonality in the source pattern of pattern number "1",
SRT(1): Root of a chord in the source pattern of pattern number "1",
STP(1): Type of the chord in the source pattern of pattern number "1",
TNMD: Flag indicative of start/stop of automatic tonality detection mode,
RUN: Flag indicative of start/stop of automatic accompaniment,
PTN: Pattern number of an accompaniment pattern and a rhythm pattern,
PRT: Part number indicative of a part of the accompaniment,
KC: Key-code,
NT: Note-code,
DG: Frequency data of the root of the chord when the tonic of the tonality is referred to,
SCTBL (i, j, k): AV scale table,
SCHL: Scale number of the AV scale table,
AVSCL (i, j): Classification table,
ATRB: Classified attribute,
NTT (i, j): Note conversion table,
AT: Index for corresponding the attribute with the note conversion table,
D: Shift table of the note conversion table.

When connected to the electric power source, the CPU 1 is activated to initiate execution of the main routine shown in FIG. 13. At step T1, the CPU 1 initializes respective flags and variables in registers and causes the program to proceed to step T2 where the CPU 1 determines presence of a key event on the keyboard 4 and causes the program to proceed to step T3. At step T3, the CPU 1 determines presence of an on-event of the pattern input switch on the operation panel 5. If the answer at step T3 is "No", the program proceeds to step T6. If the answer at step T3 is "Yes", the program proceeds to step T4 where the CPU 1 executes input processing of a pattern number selected by the player, the accompaniment pattern and the rhythm pattern and stores them as an input pattern number "1" respectively in the accompaniment memory 12 and the rhythm pattern memory 11. When the program proceeds to step T5, the CPU 1 executes input processing of the chord and tonality of the accompaniment pattern selected by the player and stores the root of the chord as SRT (1), the type of the chord as STP (1), the tonic of the tonality as SS (1, 0) and the mode of the tonality as SS (1, 1) in the register. At the following step T6, the CPU 1 determines presence of an on-event of the tonality setting switch on the operation panel 5. If the answer at step T6 is "No", the program proceeds to step T9. If the answer at step T6 is "Yes", the program proceeds to step T7 where the CPU 1 executes input processing of the tonality selected by the player and stores the tonic of the tonality as TN and the mode of the tonality as MD in the register. Subsequently, the CPU 1 executes at step T8 processing for automatic formation of a note conversion table and causes the program to proceed to step T9. At step T9, the CPU 1 determines presence of an on-event of the automatic tonality mode detection switch on the operation panel 5. If the answer at step T9 is "No", the program proceeds to step T11 shown in FIG. 14. If the answer at step T9 is "Yes", the program proceeds to step T10 where the CPU 1 inverts the flag TNMD indicative of the automatically detected tonality mode and causes the program to proceed to step T11.

At step T11 shown in FIG. 14, the CPU 1 determines presence of an on-event of the pattern selection switch on the operation panel 5. If the answer at step T11 is "No", the program proceeds to step T13. If the answer at step T11 is "Yes", the program proceeds to step T12 where the CPU 1 stores a pattern number selected by the pattern selection switch as PTN in the register and causes the program to proceed to step T13. At step T13, the CPU 1 determines presence of an on-event of the start/stop switch on the operation panel 5. If the answer at step T13 is "No", the program proceeds to step T17. If the answer at step T13 is "Yes", the program proceeds to step T14 where the CPU 1 inverts the flag RUN and determines at step T15 whether the flag RUN has been set as "1" or not. When the flag RUN has not been set as "1", the CPU 1 determines a "No" answer at step T15 and causes the program to proceed to step T17. When the flag RUN has been set as "1", the CPU 1 determines a "Yes" answer at step T15 and causes the program to proceed to step T16 where the CPU 1 resets the timing clock and causes the program to proceed to step T17. At step 17, the CPU 1 executes other processing for selection of a tone color and the like and returns the program to step T2 shown in FIG. 13 to repeat the foregoing processing.

Figure 15:
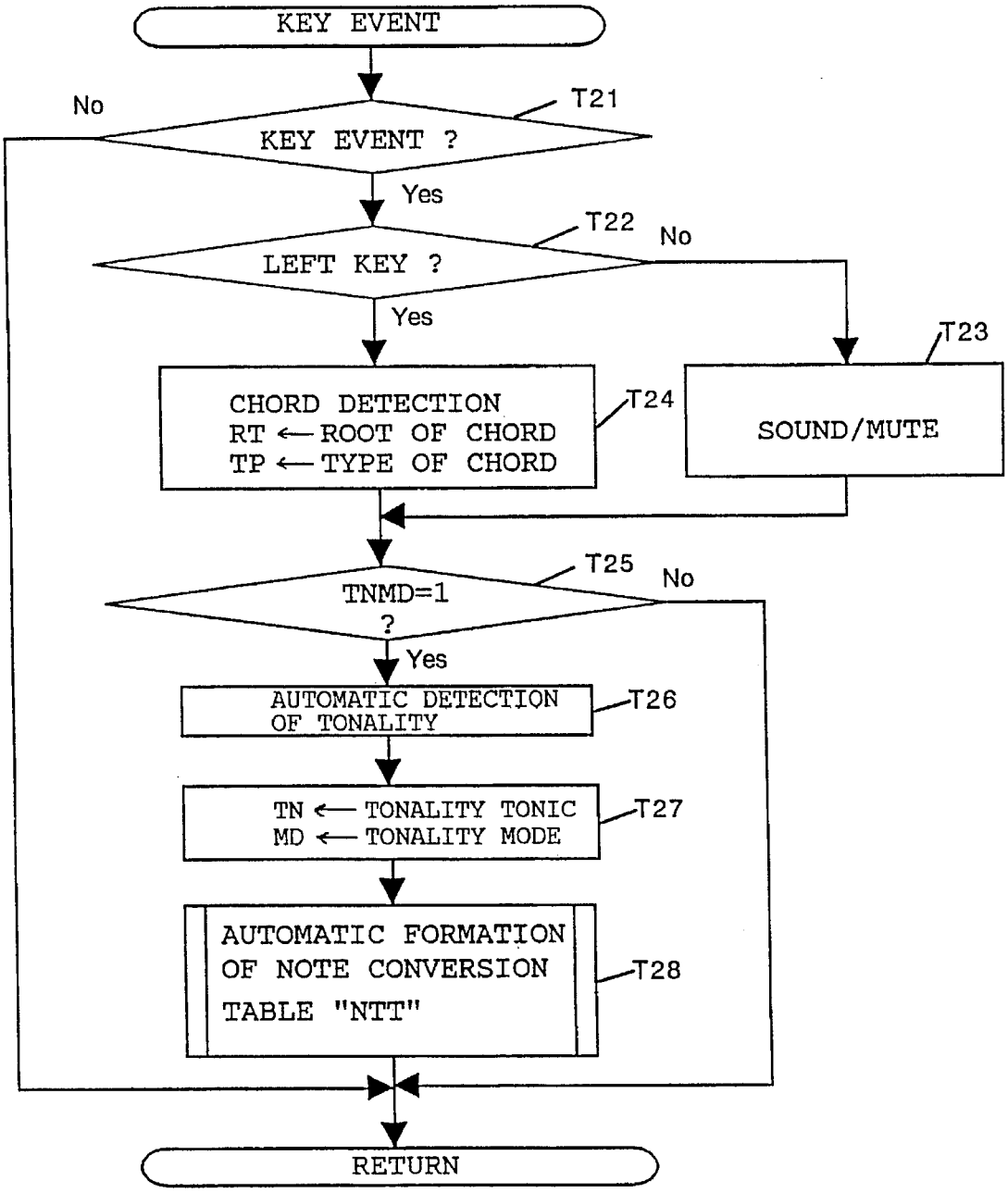
FIG. 15 is a flow chart for processing of a key event.

In the processing for determining presence of a key event on the keyboard 4 shown in FIG. 15, the CPU 1 returns the program to the main routine at step T21 if there is not any key event on the keyboard 4. If a key event is present on the keyboard 4, the program proceeds to step T22 where the CPU 1 determines whether the key event is in the left-hand key area or not and determines whether the flag RUN is "1" or not. If the answer at step T22 is "No", the program proceeds to step T23 where the CPU 1 executes processing for generation or mute of a musical sound and causes the program to proceed to step T25. If the answer at step T22 is "Yes", the program proceeds to step T24 where the CPU 1 detects a chord defined by a key-code of the key event to store the root of the detected chord as RT in the register and to store the type of the detected chord as TP in the register and causes the program to proceed to step T25. At step T25, the CPU 1 determines whether the flag TNMD indicative of the automatically detected tonality mode is "1" or not. If the answer at step T25 is "No", the program returns to the main routine. If the answer at step T25 is "Yes", the program proceeds to step T26 where the CPU 1 executes processing for automatic detection of the mode of the tonality and causes the program to proceed to step T27. At step T27, the CPU 1 stores the tonic of the detected tonality as TN and the mode of the detected tonality as MD in the register. Subsequently, the CPU 1 executes at step T28 processing for automatic formation of a note conversion table NTT and returns the program to the main routine.

Figure 16:
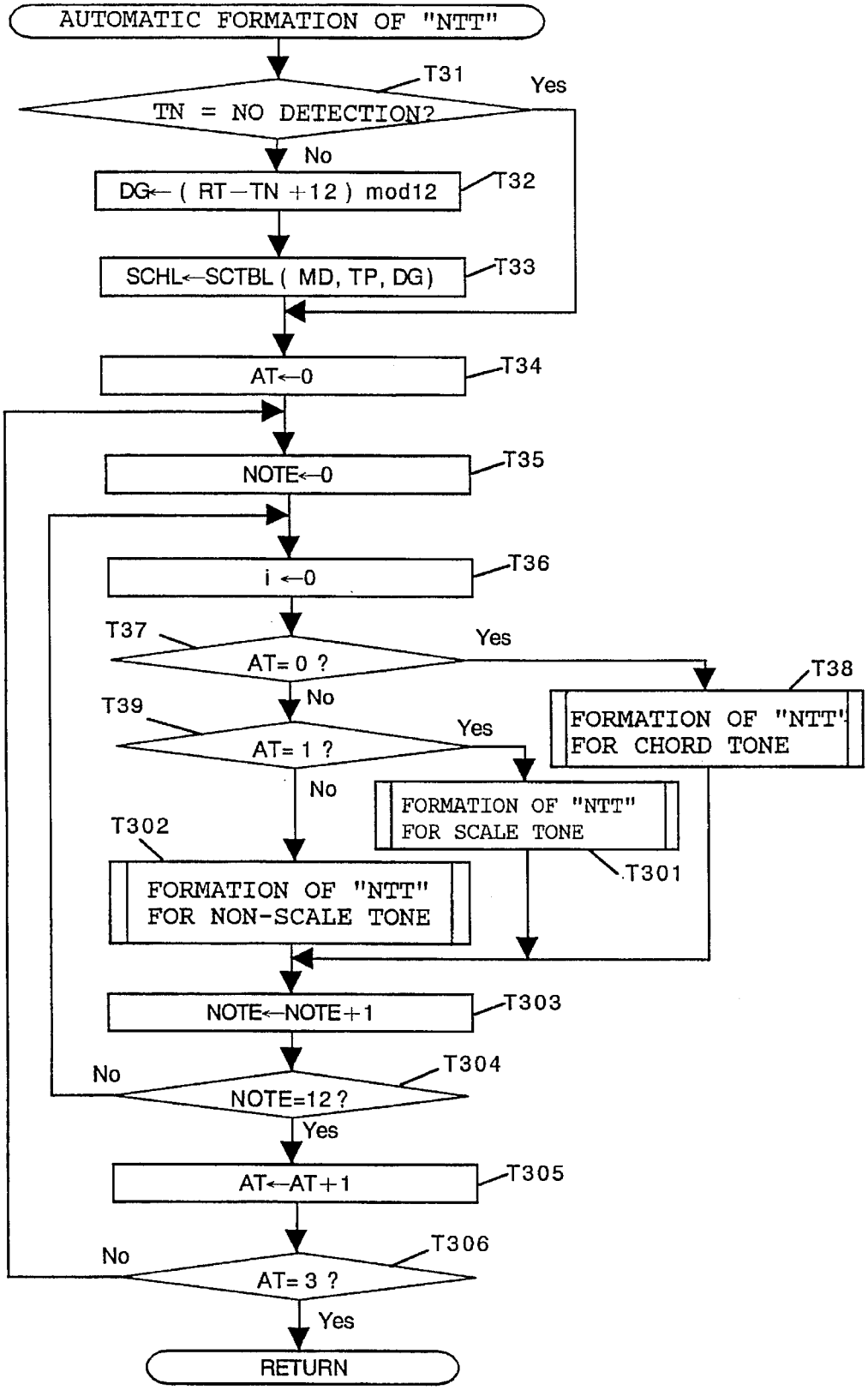
FIG. 16 is a flow chart for processing of automatic formation of a note conversion table.

In the processing for automatic formation of a note conversion table NTT shown in FIG. 16, the CPU 1 determines at step T31 whether the tonic TN of the tonality has been detected or not. If the answer at step T31 is "No", the program proceeds to step T34. If the answer at step T31 is "Yes", the program proceeds to step T32 where the CPU 1 calculates a frequency data of the root RT of the detected chord with reference to the tonic TN of the detected tonality and stores the calculated frequency data as DC in the register. At the following step T33, the CPU 1 stores the mode MD of the detected tonality, the type TP of the detected chord and a scale number SCHL of the AV scale table SCTBL (MD, TP, DG) corresponding with the frequency table DG in the register and causes the program to proceed to step T34.

Figure 17:
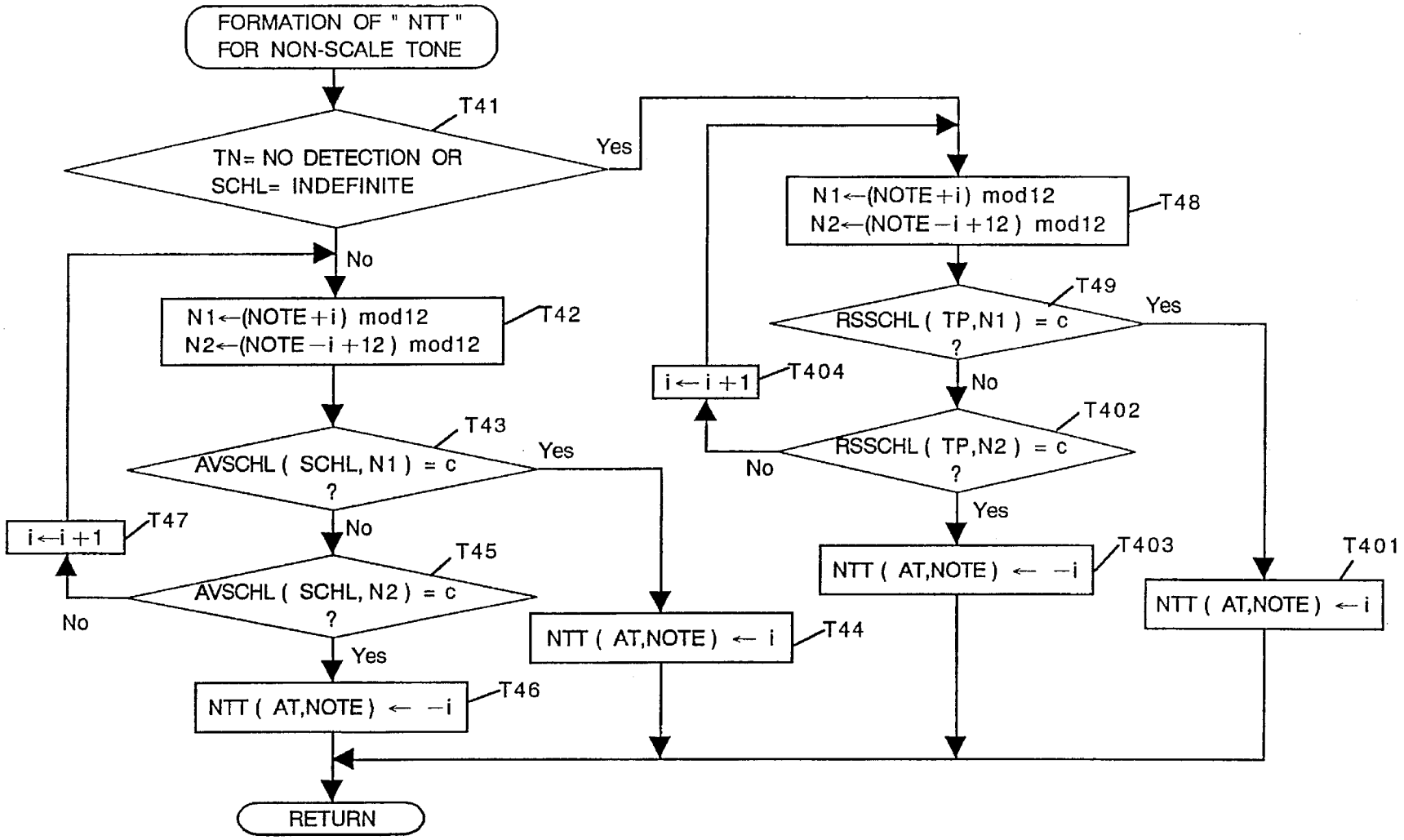
FIG. 17 is a flow chart for processing for automatic formation of a note conversion table for a chord tone.
Figure 18:
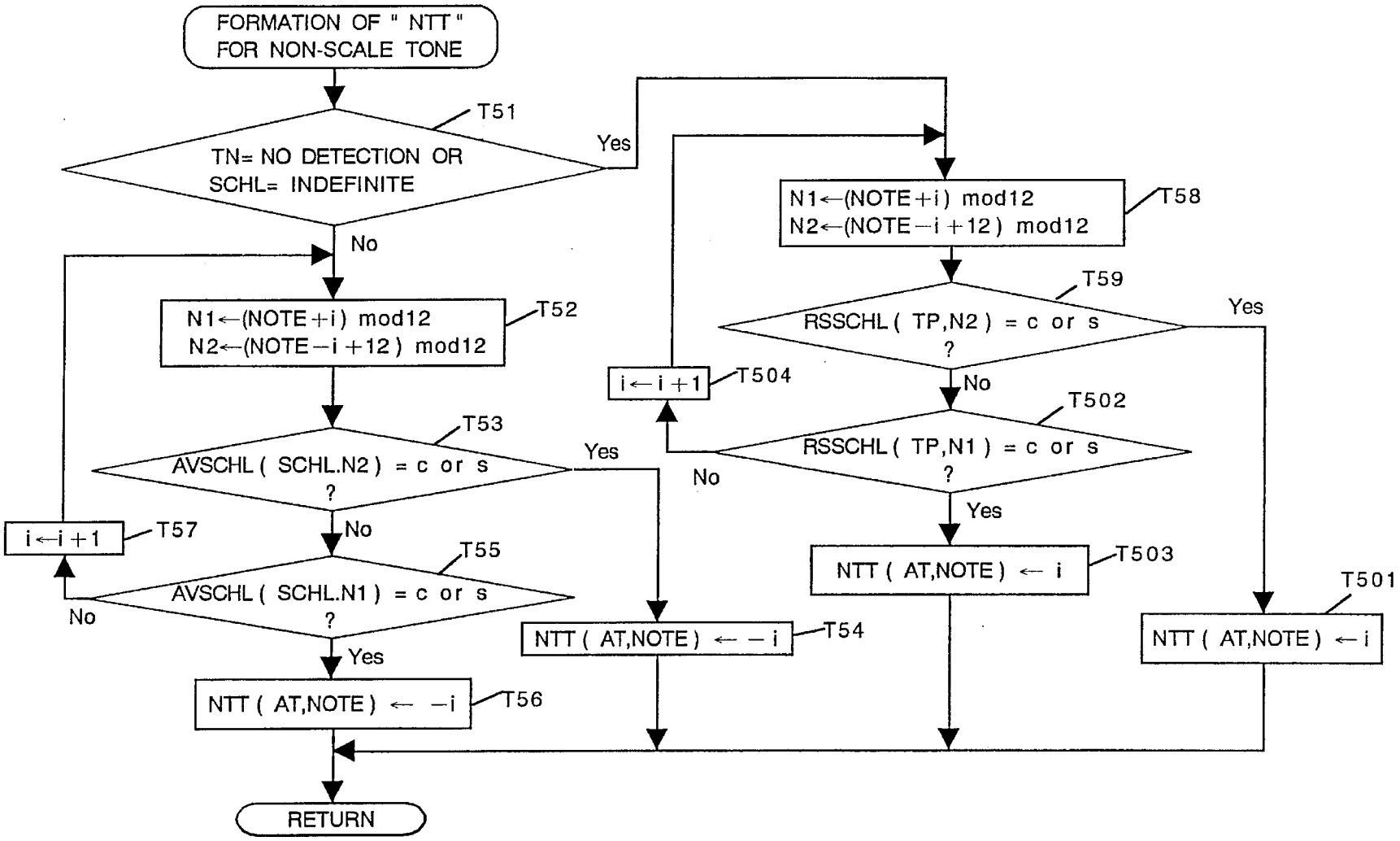
FIG. 18 is a flow chart for processing for automatic formation of a note conversion table for a scale tone.
Figure 19:
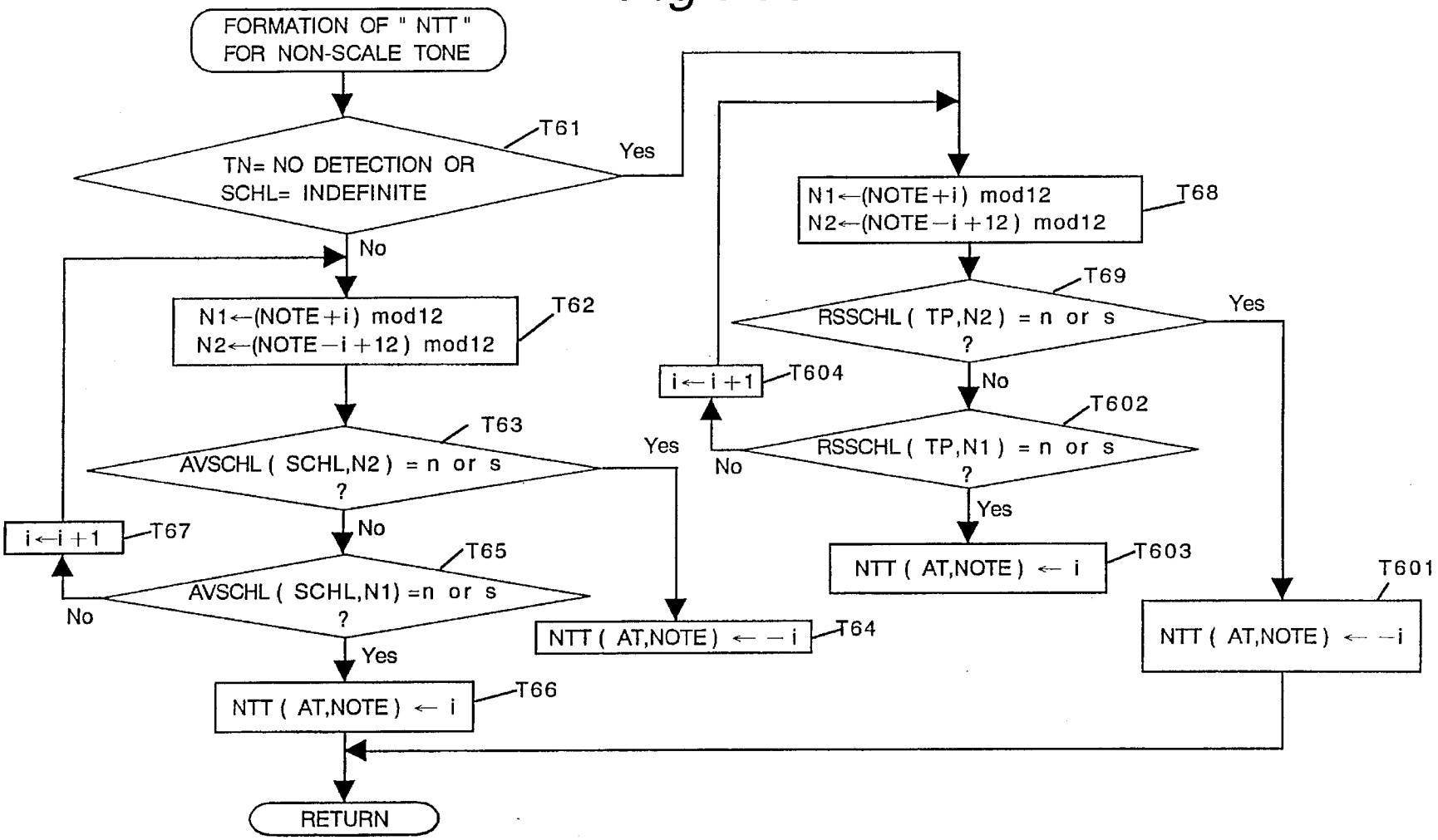
FIG. 19 is a flow chart for processing for automatic formation of a note conversion table for a non-scale tone.

At step T34, the CPU 1 sets an index AT for designating a note conversion table for each attribute of the chord tone, the scale tone and the non-scale tone as "0" and causes the program to proceed to step T35 where the CPU 1 sets a note code NOTE for designation of twelve (12) pitch names as "0". Subsequently, the CPU 1 sets at step T36 a variable "1" indicative of a step number for formation of a shift data of the note conversion table as "0" and determines at step T37 whether the index AT is "0" or not. If the answer at step T37 is "Yes", the program proceeds to step T38 where the CPU 1 executes processing for forming a note conversion table NTT for the chord tone as shown in FIG. 17 and causes the program to proceed to step T303. If the answer at step T37 is "No", the program proceeds to step T39 where the CPU 1 determines whether the index AT is "1" or not. If the answer at step T39 is "Yes", the program proceeds to step T301 where the CPU 1 executes processing for forming a note conversion table NTT for the scale tone as shown in FIG. 18 and causes the program to proceed to step T303. If the answer at step T39 is "No", the program proceeds to step T302 where the CPU 1 executes processing for forming a note conversion table NTT for the non-scale tone as shown in FIG. 19 and causes the program to proceed to step T303.

When the program proceeds to step T303, the CPU 1 renews the note code NOTE by increment of "1" and causes the program to proceed to step T304 where the CPU 1 determines whether the note code NOTE is "12" or not. Thus, until the note code NOTE becomes equal to "12", the CPU 1 will repeat the processing at step T36 to T303 for forming the note conversion table for one of the attributes. When the note code NOTE becomes equal to "12", the CPU 1 determines a "Yes" answer at step T304 and causes the program to proceed to step T305 where the CPU 1 renews the index AT by increment of "1". Thus, the CPU 1 will repeat the processing at step T35 to T305 for successively forming the note conversion tables for the other attributes until the index At becomes equal to "3". When the index At becomes equal to "3", the CPU 1 determines a "Yes" answer at step T306 and returns the program to the main routine.

In the processing for forming the note conversion table NTT for the chord tone as shown in FIG. 17, the CPU 1 determines at step T41 a condition where the tonic TN of the tonality is not detected or the scale number SCHL of the AV scale is indefinite. If such a condition is not satisfied, the CPU 1 causes the program to proceed to step T42 for forming the note conversion table based on the tonality by processing at step T43 to T46. If such a condition as described above is satisfied, the CPU 1 causes the program to proceed to step T48 for forming the note conversion table based on the chord by processing at step T49 to T403.

When the program proceeds to step T42, the CPU 1 calculates "(NOTE+1)mod 12" to obtain a note code of a pitch name at a higher side in "1" number than the currently noticed pitch name and stores the note code as N1 in the register. At this step, the CPU 1 further calculates "(NOTE–1+12)mod12 to obtain a note code of a pitch name at a lower side in "i" number than the currently noticed pitch name and stores the note code as N2 in the register. Thus, each note code of higher and lower pitch names changes in accordance with an increase of "i" one by one in sequence from the currently noticed pitch name and is stored as N1 and N2 in the register. Hereinafter, the processing at step T42 is simply called "Shift number processing".

When the shift number processing has finished at step T42, the CPU 1 determines whether AVSCHL (SCHL, N1) indicative of an attribute of a pitch name of the note code N1 at the selected scale number SCHL of the AV scale is the chord tone (c) or not. If the answer at step T43 is "Yes", the program proceeds to step T44 where the CPU 1 stores the shift data "i" as NTT (At, NOTE) in the register and returns the program to the main routine. If the answer at step T43 is "No", the program proceeds to step T45 where the CPU 1 determines whether AVSCHL (SCHL, N2) is the chord tone (c) or not. If an attribute of a pitch name of the note code N2 is the chord tone, the CPU 1 determines a "Yes" answer at step T45 and causes the program to proceed to step T46 where the CPU 1 stores a shift data "–i" as NTT (AT, NOTE) in the register and returns the program to the main routine. If the answer at step T43 is "No", the program proceeds to step T47 where the CPU 1 adds "1" to the shift data "i" and executes the processing at step T42 to T45. With the processing described above, a shift data based on the tonality is obtained with respect to a note code NOTE.

In the processing for forming the note conversion table based on the chord, the CPU 1 executes at step T48 the shift number processing and determines at step T49 whether RSSCHL (TP, N1) indicative of an attribute of a pitch name of the note code N1 in the selected scale is the chord tone (c) or not. If the attribute is the chord tone (c), the CPU 1 determines "Yes" answer at step T49 and causes the program to proceed to step T401 where the CPU 1 stores the shift data "i" as NTT (AT, NOTE) in the register and returns the program to the main routine. If the answer at step T49 is "No", the program proceeds to step T402 where the CPU 1 determines whether RSSCHL (TP, N2) is the chord tone (c) or not. If an attribute of a pitch name of the note code N2 is the chord tone, the CPU 1 determines a "Yes" answer at step T402 and causes the program to proceed to step T403 where the CPU 1 stores the shift data "–1" as NTT (AT, NOTE) in the register and returns the program to the main routine. If the answer at step T402 is "No", the program proceeds to step T404 where the CPU 1 adds "1" to the shift data "i" and executes the processing at step T48 to T402. With the processing described above, a shift data based on the chord is obtained with respect to a note code NOTE.

Processing for forming a note conversion table of the scale tone at step T51 to T504 shown in FIG. 18 and processing for forming a note conversion table of the non-scale tone at step T61 to T604 shown in FIG. 19 are substantially the same as the processing for forming the note conversion table of the chord tone shown in FIG. 17. In the processing for forming the note conversion table of the scale tone, the CPU 1 determines at step T53 whether AVSCHL (SCHL, N2) is the chord tone (c) or the scale tone (s). If an attribute of a lower pitch name is the chord tone or the scale tone, the program proceeds to step T54 where the CPU 1 stores "–1" as a shift data NTT (AT, NOTE) in the register. If the attribute of the lower pitch name is not the chord tone nor the scale tone, the program proceeds to step T55 where the CPU 1 determines whether an attribute of an upper pitch name is the chord tone or the scale tone. When the attribute of the upper pitch name becomes the chord tone or the scale tone, the CPU 1 determines a "Yes" answer at step T55 and stores "i" as a shift data NTT (AT, NOTE) in the register at step T56. Similarly, if an attribute of a lower pitch name is the chord tone or the scale tone at the scale selected by the type of the chord, the CPU 1 stores –i" as a shift data NTT (AT, NOTE) at step T501. If the attribute of the lower pitch name is not the chord tone nor the scale tone, the CPU 1 determines at step T502 whether an attribute of an upper pitch name is the chord tone or the scale tone. Thus, the CPU 1 stores at step T503 "i" as a shift data NTT (AT, NOTE) in the register when the attribute of the upper pitch name becomes the chord tone or the scale tone.

In the processing for forming the note conversion table of the non-scale tone, the CPU 1 determines at step T63 whether AVSCHL (SCHL, N2) is the non-scale tone (n) or the scale tone (s). If an attribute of a lower pitch name is the non-scale tone or the scale tone, the program proceeds to step T64 where the CPU 1 stores "–i" as a shift data NTT (AT, NOTE) in the register. If the attribute of the lower pitch name is not the non-scale tone nor the scale tone, the program proceeds to step T65 where the CPU 1 determines whether an attribute of an upper pitch name is the non-scale tone or the scale tone. When the attribute of the upper pitch name becomes the non-scale tone or the scale tone, the CPU 1 determines a "Yes" answer at step T65 and stores "i" as a shift data NTT (AT, NOTE) in the register at step T66. Similarly, if an attribute of a lower pitch name is the non-scale tone or the scale tone at the scale selected by the type of the chord, the CPU 1 stores "–1" as a shift data NTT (AT, NOTE) at step T601. If the attribute of the lower pitch name is not the non-scale tone nor the scale tone, the CPU 1 determines at step T602 whether an attribute of an upper pitch name is the non-scale tone or the scale tone. Thus, the CPU 1 stores "1" as a shift data NTT (AT, NOTE) in the register at step T603 when the attribute of the upper pitch name becomes the non-scale tone or the scale tone.

With the processing described above, a note conversion table suitable for the input tonality and accompaniment data (the source pattern) is formed, and the note conversion table is applied to the following processing for tone pitch conversin of the automatic accompaniment.

Figure 20:
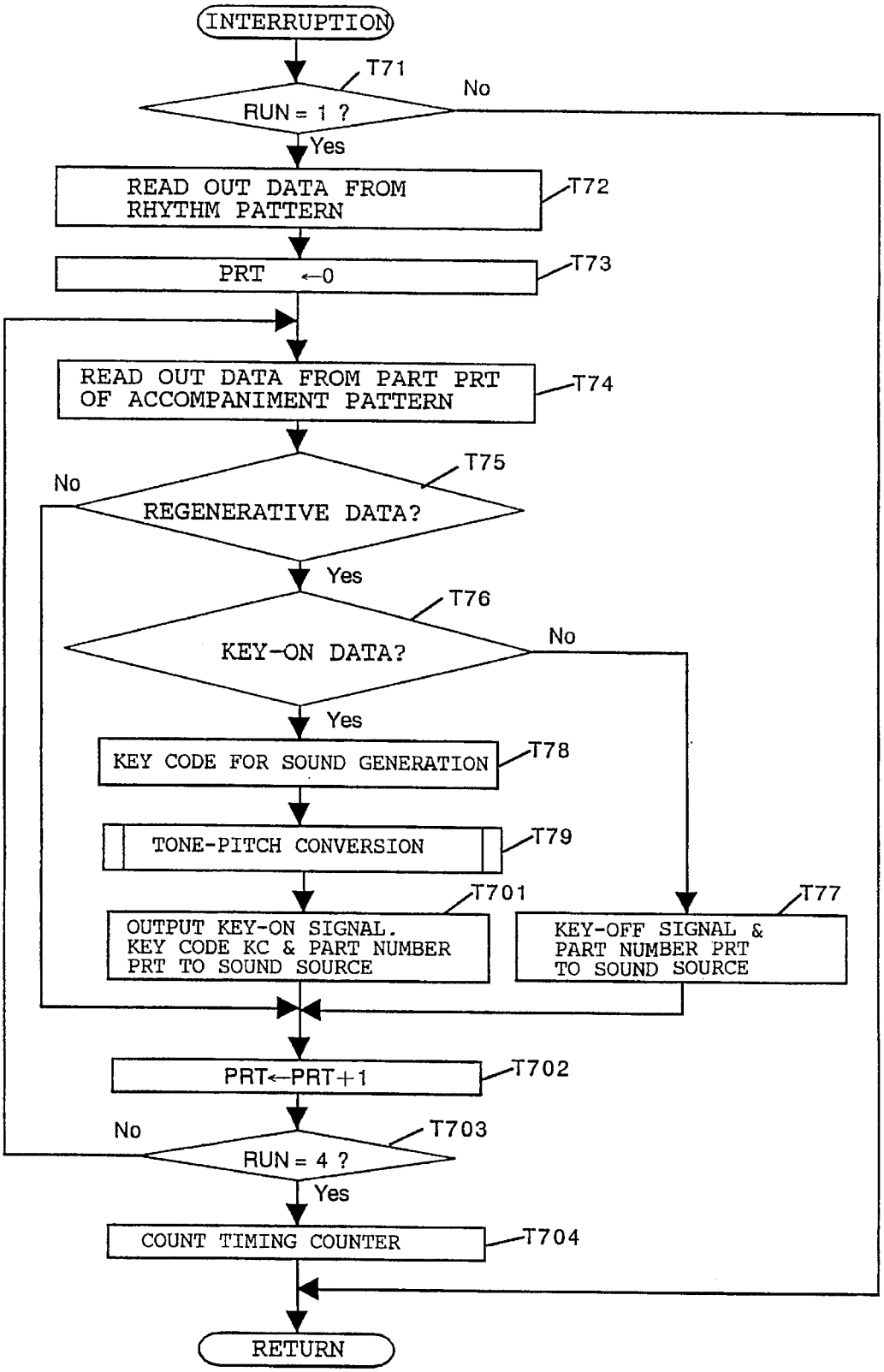
FIG. 20 is a flow chart of an interruption routine of the modified control program.

When applied with an interruption signal from the timer 10, the CPU 1 executes the interruption processing shown in FIG. 20. At step T71, the CPU 1 determines whether the flag RUN is "1" or not. If the answer at step T71 is "No", the program returns to the main routine. If the answer at step T71 is "Yes", the program proceeds to step T72 where the CPU 1 reads out a data corresponding with a current timing clock in the rhythm pattern of the pattern number PTN and applies it to the sound source 8. At the following step T73, the CPU 1 sets the part number PRT indicative of a regenerative part of the accompaniment pattern as "0" and causes the program to proceed to step T74. A step T74, the CPU 1 reads out a data corresponding with a current timing clock in the part PRT of the accompaniment pattern of the pattern number PTN and causes the program to proceed to step T75 where the CPU 1 determines whether there is a regenerative data or not. If there is not any regenerative data, the program proceeds to step T702.

If the answer at step T75 is "Yes", the program proceeds to step T76 where the CPU 1 determines whether the regenerative data is a key-on data or not. If the answer at step T76 is "No", the program proceeds to step T77 where the CPU 1 applies a key-off signal and a channel number indicative of the part number PRT to the sound source 8 for mute of a musical sound. If the answer at step T76 is "Yes", the program proceeds to step T78 where the CPU 1 stores a key code KC as a read-out data of the accompaniment pattern in the register and causes the program to proceed to step T79. At step T79, the CPU 1 executes processing for tone pitch conversion shown in FIG. 21. When the program proceeds to step T701 after execution of the processing for tone pitch conversion, the CPU 1 applies a key-on signal, the key code converted in tone pitch and a channel number indicative of the part number PRT to the sound source 8 for generation of a musical sound. Subsequently, the CPU 1 adds "1" to the part number PRT at step T702 and determines at step T703 whether the part number PRT is "4" or not. If a regenerative part remains in the accompaniment pattern, the CPU 1 determines a "No" answer at step T703 and executes the processing at step T74 to T703. If the answer at step T703 is "Yes", the program proceeds to step T704 where the CPU 1 counts the timing count and returns the program to the main routine.

Figure 21:
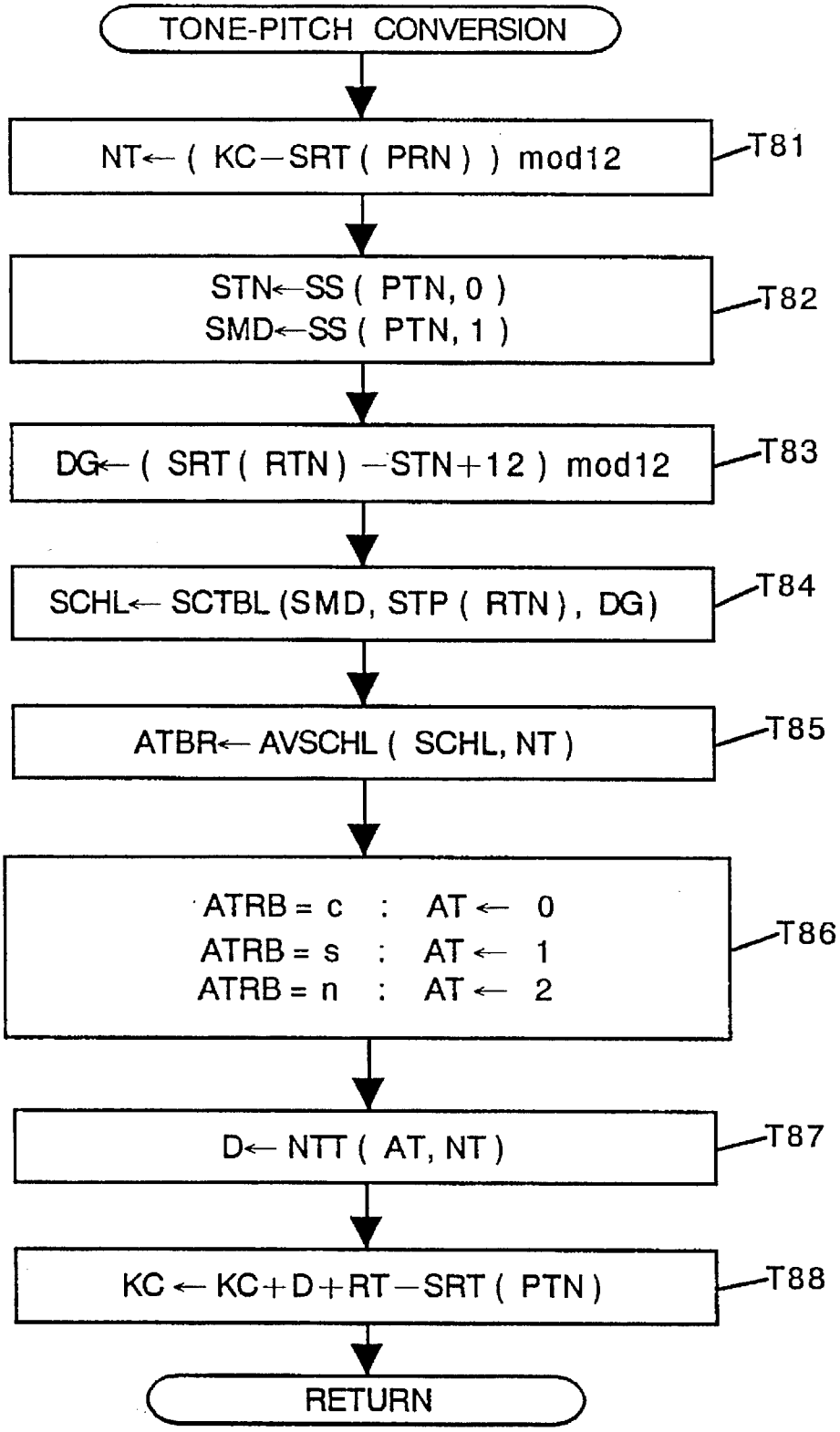
FIG. 21 is a flow chart for processing of tone pitch conversion.

In the processing for tone pitch conversion shown in FIG. 21, the CPU 1 shifts at step T81 the key code KC indicative of the read-out data in tone pitch in accordance with the root SRT (PTN) of the chord in the accompaniment pattern of the pattern number PTN and stores the note code NT in the register. At the following step T82, the CPU 1 stores the tonic SS (PTN, 0) of the tonality in the source pattern of the accompaniment pattern of the pattern number PTN as STN in the register and stores the mode SS (PTN, 1) of the tonality as SMD in the register. When the program proceeds to step T83, the CPU 1 calculates a frequency data DC of the root SRT (PTN) of the chord in the source pattern with reference to the tonic STN of the tonality in the source pattern and stores the calculated frequency data DG in the register. At the following step T84, the CPU 1 stores a scale number SCTBL (SMD, STP (PTN), DG) corresponding with the mode SMD of the tonality in the source pattern, the type STP (PTN) of the chord in the source pattern and the frequency data DG as SCHL in the register and causes the program to proceed to step T85. At step T85, the CPU 1 obtains an attribute AVSCHL (SCHL, NT) from the classification table on a basis of the note code NT corresponding with the scale number SCHL and the key code of the accompaniment pattern and stores the attribute AVSCHL (SCHL, NT) as ATRB in the register. When the program proceeds to step T86, the CPU 1 sets the index AT as "0" when the attribute ATRB is the chord tone (c), sets the index AT at "1" when the attribute ATRB is the scale tone (s) and sets the index AT as "2" when the attribute ATRB is the non-scale tone (n). Thus, a note conversion table NTT (AT) is selected in accordance with the attribute ATRB.

Subsequently, the CPU 1 reads out at step T87 the shift data NTT (AT, NT) from the selected note conversion table NTT (AT) and stores the shift data NTT (AT, NT) as D in the register. At the following step T88, the CPU 1 adds the shift data D and the root RT of the detected chord to the key code KC indicative of the read-out data applied from the source pattern and subtracts the root SRT (PTN) of the chord in the current accompaniment pattern to convert the key code in tone pitch. Thereafter, the program returns to the main routine.

With the processing for tone pitch conversion described above, the key code of the source pattern is converted into a tone pitch corresponding with the designated tonality and the chord applied from the keyboard 4 to harmonize automatic accompaniment with performance played by the player.

As is understood from the above description, the note conversion table is automatically formed in accordance with the designated tonality, and the key code of the read-out data from the accompaniment pattern is classified into either one of the chord tone, the scale tone and the non-scale tone on a basis of the designated tonality. Thus, the classified key code is converted in tone pitch on a basis of the note conversion table. Accordingly, even if different accompaniment patterns are applied, the key code is converted into a tone pitch musically suitable for the respective accompaniment patterns. When the source pattern of the accompaniment patterns is produced by a pattern producer or a player, it is not required to produce the note conversion table for each of the accompaniment patterns. Since the note conversion table is formed in accordance with the tonality, it is able to effect automatic accompaniment suitable for the tonality of performance played by the player.

What is claimed is:

1. An automatic accompaniment apparatus comprising:

memory means for storing a source pattern produced in accordance with a corresponding chord;

determination means for determining an attribute of tone pitch information of the source pattern based on a scale of the corresponding chord, wherein the attribute comprises at least one of a scale tone representing a tone existing on the scale of the corresponding chord, and a non-scale tone representing a tone note existing on the scale of the corresponding chord;

means for receiving an input chord from an input source and forming tone pitch conversion information in accordance with the attribute and the input chord; and tone pitch conversion means for converting the tone pitch information based on the tone pitch conversion information to generate converted tone pitch information.

2. An automatic accompaniment apparatus as claimed in claim 1, wherein the scale tone includes a chord tone representing a tone that exists on the scale of the corresponding chord and is a component tone of the corresponding chord.

3. An automatic accompaniment apparatus as claimed in claim 1, wherein the determination means includes a classification table which defines the attribute based on pitch name information and chord type information.

4. An automatic accompaniment apparatus as claimed in claim 1, wherein the tone pitch conversion means includes a conversion table which defines the tone pitch conversion information based on pitch name information and chord type information.

5. An automatic accompaniment apparatus as claimed in claim 1, further comprising sound reproduction means for generating audible signals based on the converted tone pitch information.

6. An automatic accompaniment apparatus as claimed in claim 2, wherein the determination means includes a classification table which defines the attribute based on pitch name information and chord type information.

7. An automatic accompaniment apparatus as claimed in claim 6, wherein the tone pitch conversion means includes a conversion table which defines the tone pitch conversion information based on pitch name information and chord type information.

8. An automatic accompaniment apparatus as claimed in claim 7, further comprising sound reproduction means for generating audible signals based on the converted tone pitch information.

9. An automatic accompaniment apparatus comprising:

memory means for storing a source pattern comprising a plurality of notes and a corresponding chord;

input means for inputting an input chord;

determination means for determining an attribute of a tone pitch of each note of the source pattern based on a scale of the corresponding chord, wherein the attribute comprising at least one of a scale tone representing a tone existing on the scale of the corresponding chord, and a non-scale tone representing a tone not existing on the scale of the corresponding chord;

means for producing tone pitch conversion information for each note of the source pattern based on the attribute; and tone pitch conversion means for converting the tone pitch of each note of the source pattern based on the tone pitch conversion information and the input chord to generate accompaniment notes.

10. An automatic accompaniment apparatus as claimed in claim 9, wherein the scale tone includes a chord tone representing a tone that exists on the scale of the corresponding chord and is a component tone of the corresponding chord.

11. An automatic accompaniment apparatus as claimed in claim 9, wherein the determination means includes a classification table which defines the attribute based on pitch name information and chord type information.

12. An automatic accompaniment apparatus as claimed in claim 9, wherein the tone pitch conversion means includes a conversion table which defines the tone pitch conversion information based on pitch name information and chord type information.

13. An automatic accompaniment apparatus as claimed in claim 9, further comprising sound reproduction means for generating audible signals based on the accompaniment notes.

14. An automatic accompaniment apparatus as claimed in claim 10, wherein the determination means includes a classification table which defines the attribute based on pitch name information and chord type information.

15. An automatic accompaniment apparatus as claimed in claim 14, wherein the tone pitch conversion means includes a conversion table which defines the tone pitch conversion information based on pitch name information and chord type information.

16. An automatic accompaniment apparatus as claimed in claim 15, further comprising sound reproduction means for generating audible signals based on the accompaniment notes.

* * * * *